US009084449B2

(12) United States Patent
Bell et al.

(10) Patent No.: US 9,084,449 B2
(45) **Date of Patent: *Jul. 21, 2015**

(54) METHOD OF KNITTING A KNITTED COMPONENT FOR AN ARTICLE OF FOOTWEAR

(71) Applicant: NIKE, Inc., Beaverton, OR (US)

(72) Inventors: Thomas G. Bell, Portland, OR (US); Bhupesh Dua, Portland, OR (US); Julie A. Huffman, Portland, OR (US); Amy Lyttle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,569

(22) Filed: May 7, 2014

(65) Prior Publication Data

US 2014/0352179 A1 Dec. 4, 2014

Related U.S. Application Data

(63) Continuation of application No. 13/907,054, filed on May 31, 2013.

(51) Int. Cl.
*D04B 1/24* (2006.01)
*A43B 1/04* (2006.01)
(Continued)

(52) U.S. Cl.
CPC ... *A43B 1/04* (2013.01); *A43B 1/00* (2013.01); *A43B 3/0031* (2013.01); *A43B 23/024* (2013.01); *A43B 23/028* (2013.01); *A43B 23/0235* (2013.01); *A43B 23/0245* (2013.01); *A43B 23/07* (2013.01); *A43D 11/00* (2013.01);
(Continued)

(58) Field of Classification Search
CPC ..... A43B 23/04; A43B 23/042; A43B 23/26
USPC ..... 66/169 R, 170, 171, 177; 36/3 R, 3 A, 84, 36/114, 47, 54, 49
See application file for complete search history.

(56) References Cited

U.S. PATENT DOCUMENTS 601,192 A 3/1898 Woodside
1,215,198 A 2/1917 Rothstein
(Continued)

FOREIGN PATENT DOCUMENTS

CN 103556384 2/2014
DE 870963 C 3/1953
(Continued)

OTHER PUBLICATIONS

Letter from Bruce Huffa dated Dec. 23, 2013 (71 pages).
(Continued)

*Primary Examiner* — Danny Worrell
(74) *Attorney, Agent, or Firm* — Plumsea Law Group, LLC

(57) ABSTRACT

An article of footwear incorporates a textile upper. The upper comprises a knitted component. The knitted component may be warp knitted. The knitted component has an outer side and an inner side that can have different knit configurations. The knitted component can also incorporate portions of a single layer construction and portions of a double layer construction. The double layer construction forms pockets on portions of the knitted component. Inserts can be placed into the pockets to provide support, stability, or other desired properties to the portions of the knitted component.

23 Claims, 18 Drawing Sheets

(51) Int. Cl.

| | |
|---|---|
| ***A43B 23/07*** | (2006.01) |
| ***D04B 9/42*** | (2006.01) |
| ***A43B 1/00*** | (2006.01) |
| ***A43B 23/02*** | (2006.01) |
| ***A43D 11/00*** | (2006.01) |
| ***D04B 21/20*** | (2006.01) |
| ***A43B 3/00*** | (2006.01) |
| ***A43D 111/00*** | (2006.01) |

(52) U.S. Cl.

CPC ..... *A43D 111/00* (2013.01); *D04B 1/24* (2013.01); *D04B 9/42* (2013.01); *D04B 21/207* (2013.01)

(56) References Cited

U.S. PATENT DOCUMENTS

| | | | | |
|---|---|---|---|---|
| 1,597,934 | A | 8/1926 | Stimpson | |
| 1,888,172 | A | 11/1932 | Joha | |
| 1,902,780 | A | 3/1933 | Holden et al. | |
| 1,910,251 | A | 5/1933 | Joha | |
| 2,001,293 | A | 5/1935 | Wilson | |
| 2,047,724 | A | 7/1936 | Zuckerman | |
| 2,147,197 | A | 2/1939 | Glidden | |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,569,764 | A | 10/1951 | Jonas | |
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,994,322 | A | 8/1961 | Cullen et al. | |
| 3,583,081 | A | 6/1971 | Hayashi | |
| 3,694,940 | A | 10/1972 | Stohr | |
| 3,704,474 | A | 12/1972 | Winkler | |
| 3,766,566 | A | 10/1973 | Tadakoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,141,229 | A | 2/1979 | Sharpe | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,538,368 | A | 9/1985 | Mugford | |
| 4,607,439 | A | 8/1986 | Sogabe et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 5,031,423 | A | 7/1991 | Ikenaga | |
| 5,052,058 | A | 10/1991 | Mueller | |
| 5,095,720 | A | 3/1992 | Tibbals, Jr. | |
| 5,117,567 | A | 6/1992 | Berger | |
| 5,152,025 | A | 10/1992 | Hirmas | |
| 5,192,601 | A | 3/1993 | Neisler | |
| 5,345,638 | A | 9/1994 | Nishida | |
| 5,353,524 | A | 10/1994 | Brier | |
| 5,371,957 | A | 12/1994 | Gaudio | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,453,705 | B2 * | 9/2002 | Fujiwara | 66/176 |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,823,700 | B1 * | 11/2004 | Yi | 66/192 |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 | 3/2008 | Dua et al. | |
| 7,350,861 | B2 * | 4/2008 | Zaharakos | 297/228.1 |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 8,099,881 | B2 | 1/2012 | Yamamoto | |
| 8,490,299 | B2 | 7/2013 | Dua et al. | |
| 2002/0078599 | A1 | 6/2002 | Delgorgue et al. | |
| 2002/0139009 | A1 * | 10/2002 | Mark | 36/54 |
| 2002/0148258 | A1 | 10/2002 | Cole et al. | |
| 2003/0126762 | A1 | 7/2003 | Tseng | |
| 2003/0131635 | A1 | 7/2003 | Lynch et al. | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0115284 | A1 | 6/2005 | Dua | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1 | 5/2008 | Sokolowski et al. | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2011/0030244 | A1 | 2/2011 | Motawi et al. | |
| 2011/0078921 | A1 | 4/2011 | Greene et al. | |
| 2012/0233882 | A1 * | 9/2012 | Huffa et al. | 36/45 |
| 2012/0233884 | A1 | 9/2012 | Greene | |
| 2012/0246973 | A1 * | 10/2012 | Dua | 36/83 |
| 2012/0255201 | A1 | 10/2012 | Little | |
| 2012/0266362 | A1 | 10/2012 | Craig | |
| 2012/0279260 | A1 | 11/2012 | Dua et al. | |
| 2013/0160323 | A1 | 6/2013 | Hsiao | |
| 2013/0239438 | A1 * | 9/2013 | Dua et al. | 36/84 |
| 2013/0239625 | A1 * | 9/2013 | Meir et al. | 66/170 |
| 2014/0245632 | A1 * | 9/2014 | Podhajny et al. | 36/45 |
| 2014/0245633 | A1 * | 9/2014 | Podhajny | 36/45 |

(56) References Cited

U.S. PATENT DOCUMENTS

| | | | | |
|---|---|---|---|---|
| 2014/0245634 | A1* | 9/2014 | Podhajny | 36/54 |
| 2014/0259749 | A1* | 9/2014 | Taylor et al. | 36/29 |
| 2014/0352179 | A1* | 12/2014 | Bell et al. | 36/9 R |

FOREIGN PATENT DOCUMENTS

| | | | |
|---|---|---|---|
| DE | 1084173 | | 6/1960 |
| DE | 19738433 | | 4/1998 |
| DE | 19728848 | | 1/1999 |
| EP | 0448714 | | 10/1991 |
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H1150303 | | 2/1992 |
| JP | H06113905 | | 4/1994 |
| JP | H08109553 | | 4/1996 |
| JP | H11302943 | | 11/1999 |
| JP | 2000355859 | | 12/2000 |
| NL | 7304678 | | 10/1974 |
| WO | 9003744 | | 4/1990 |
| WO | 0032861 | | 6/2000 |
| WO | 0231247 | | 4/2002 |

OTHER PUBLICATIONS

Declaration of Dr. Edward C. Frederick from the US Patent and Trademark Office Inter Partes Review of US Patent No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

International Search Report and Written Opinion in connection with PCT/US2012/028576 mailed on Oct. 1, 2012.

International Search Report and Written Opinion in connection with PCT/US2012/028559 mailed on Oct. 19, 2012.

International Search Report and Written Opinion in connection with PCT/US2012/028534 mailed on Oct. 17, 2012.

International Preliminary Report on Patentability in connection with PCT/US2012/028534 mailed Sep. 17, 2013.

International Preliminary Report on Patentability in connection with PCT/US2012/028576 mailed Sep. 17, 2013.

International Search Report and Written Opinion mailed Sep. 23, 2014 in International Application No. PCT/US2014/039671.

* cited by examiner

METHOD OF KNITTING A KNITTED COMPONENT FOR AN ARTICLE OF FOOTWEAR

CROSS-REFERENCE TO RELATED APPLICATION

This application is a continuation of U.S. patent application Ser. No. 13/907,054, filed on May 31, 2013, entitled "Method of Knitting A Knitted Component For An Article of Footwear", the disclosure of which application is hereby incorporated by reference in its entirety.

BACKGROUND

The present embodiments relate generally to a method of making articles of footwear and in particular to a method of knitting a knitted component for use in making articles of footwear.

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and help to control foot motion. Accordingly, the upper and the sole structure operate cooperatively to provide a comfortable structure that is suited for a wide variety of ambulatory activities, such as walking and running. The general features and configuration of the conventional upper are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

Although the materials selected for the upper vary significantly, textile materials often form at least a portion of the exterior layer and interior layer. A textile may be defined as any manufacture from fibers, filaments, or yarns characterized by flexibility, fineness, and a high ratio of length to thickness. Textiles generally fall into two categories. The first category includes textiles produced directly from webs of filaments or fibers by randomly interlocking to construct nonwoven fabrics and felts. The second category includes textiles formed through a mechanical manipulation of yarn, thereby producing a woven fabric, for example.

SUMMARY

In one aspect, a method of making an upper for an article of footwear includes knitting a knitted textile element of unitary knit construction with a first indicating portion corresponding to the outline of a knitted component and a second indicating portion corresponding to a pocket in the knitted component. The method further includes cutting the knitted textile element along the first indicating portion to separate the knitted component from excess material of the knitted textile element. The method further includes cutting the knitted component along the second indicating portion to create an opening to the pocket, inserting an insert member into the pocket and closing the pocket and joining edges of the knitted component to form the upper.

In another aspect, a method of knitting a knitted component for use as an upper in an article of footwear includes knitting a first portion of the knitted component so that the first portion comprises a single layer construction and knitting a second portion of the knitted component so that the second portion comprises a double layer construction with a pocket. The method also includes knitting a knitted indicating portion configured to indicate a location for cutting a layer of the second portion to provide access to the pocket. The first portion, the second portion and the knitted indicating portion are of unitary knit construction.

In another aspect, an article of footwear includes an upper incorporating a knitted component where the knitted component has a first portion that comprises a single layer of material and the knitted component has a second portion that comprises two layers of material that are separated to form a pocket in the knitted component. An outer side of the first portion is formed of unitary knit construction with a first layer of the second portion and an inner side of the first portion is formed of unitary knit construction with a second layer of the second portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
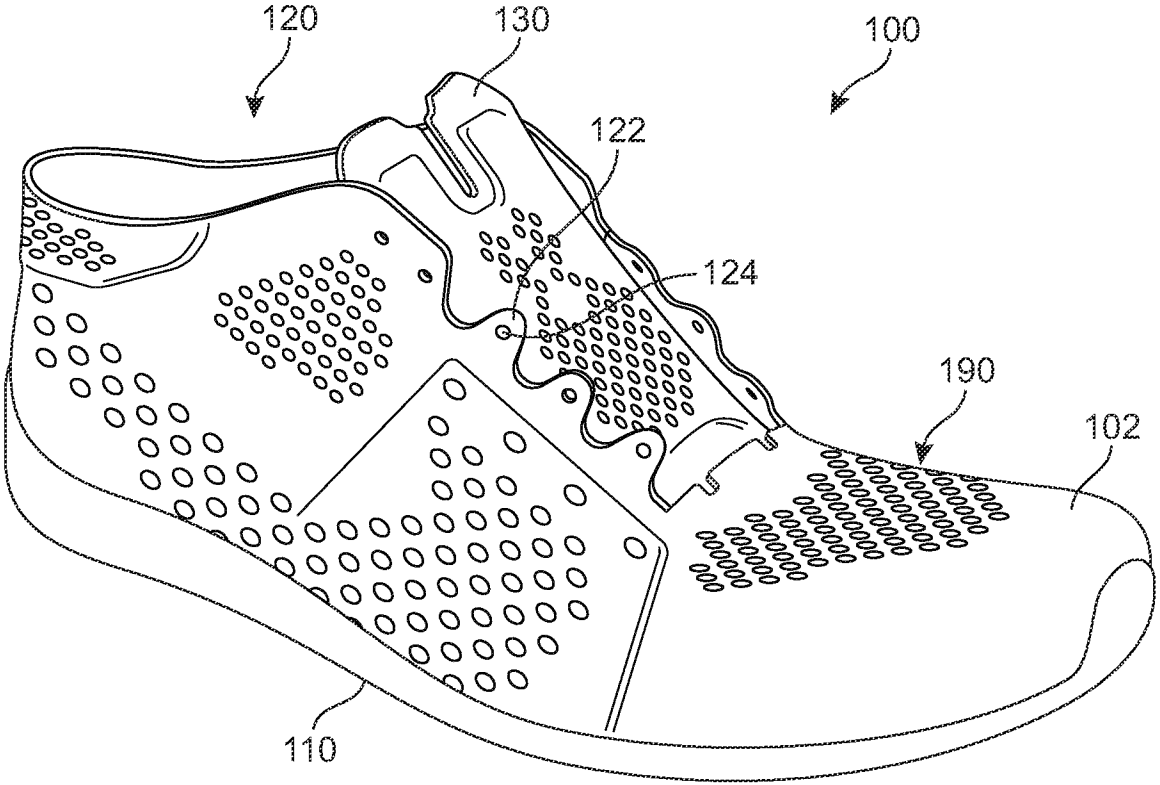
FIG. 1 is a schematic isometric view of an embodiment of an article of footwear incorporating a textile upper.

FIG. 1 is an isometric view of an embodiment of an article of footwear 100, also referred to simply as article 100. In the illustrated embodiments, article 100 takes the form of an athletic shoe, however in other embodiments article 100 could take the form of any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments, article 100 may take the form of various kinds of non-sports related footwear, including, but not limited to: slippers, sandals, high heeled footwear, loafers as well as any other kinds of footwear and/or apparel.

Article 100 may include upper 102 and sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. Moreover, in some cases, sole structure 110 may itself be optional.

Upper 102 may be generally configured to receive and cover a foot. To this end, upper 102 may include an opening 120 that provides entry to an interior of upper 102. In addition, upper 102 may include provisions for tightening or otherwise fastening upper 102. In some embodiments, for example, upper 102 is provided with lace receiving members 122, which may further comprise eyelets 124. Although not shown, some embodiments of article 100 may include a lace or other tensioning member (such as a cable) that may be used to adjust the size of opening 120 and therefore the fit of upper 102.

Some embodiments of upper 102 may include tongue 130. Tongue 130 may facilitate comfort and fit. However, it will be understood that a tongue may be optional in other embodiments.

Many conventional footwear uppers are formed from multiple material elements (e.g., textiles, polymer foam, polymer sheets, leather, synthetic leather) that are joined through stitching or bonding, for example. In contrast, a majority of upper 102 is formed from a knitted component 140, which extends through each of a forefoot portion 10, a midfoot portion 12, and a heel portion 14, and along both a lateral side 16 and a medial side 18. In some embodiments, knitted component 140 may also include a tongue 130. In addition, knitted component 140 forms portions of both an exterior surface and an opposite interior surface of upper 102. As such, knitted component 140 defines at least a portion of the void within upper 102. In some configurations, knitted component 140 may also extend under the foot. In other embodiments, however, a strobel sock may be secured to knitted component 140 and an upper surface of sole structure 110, for example a midsole, thereby forming a portion of upper 102 that extends under a sockliner.

As described in further detail below, knitted component 140 includes upper 102 and may generally comprise a knit material, such as a knit textile element. In some embodiments, therefore, upper 102 may be substantially flexible and lightweight relative to some other conventional upper materials. Although the embodiments illustrate an upper comprised entirely of the knit material, other embodiments of an upper may be only partially comprised of a knit material (or textile material).

Some embodiments can include one or more holes, apertures, openings, gaps, slots or other such structures. As an exemplary embodiment, upper 102 may include various groups of holes arranged in various configurations and in various locations, collectively referred to herein as plurality of holes 190. However, in other embodiments such holes may be optional. Moreover, the particular number, sizes, shapes and configurations of holes within plurality of holes 190 may vary from one embodiment to another. As discussed further below, in some embodiments some holes may extend through the entire thickness of upper 102, while other holes may only extend partially through the thickness of upper 102. The specific configurations could be selected to achieve breathability in certain areas, modify stretching in some places and/or to provide aesthetic appeal.

Figure 2:
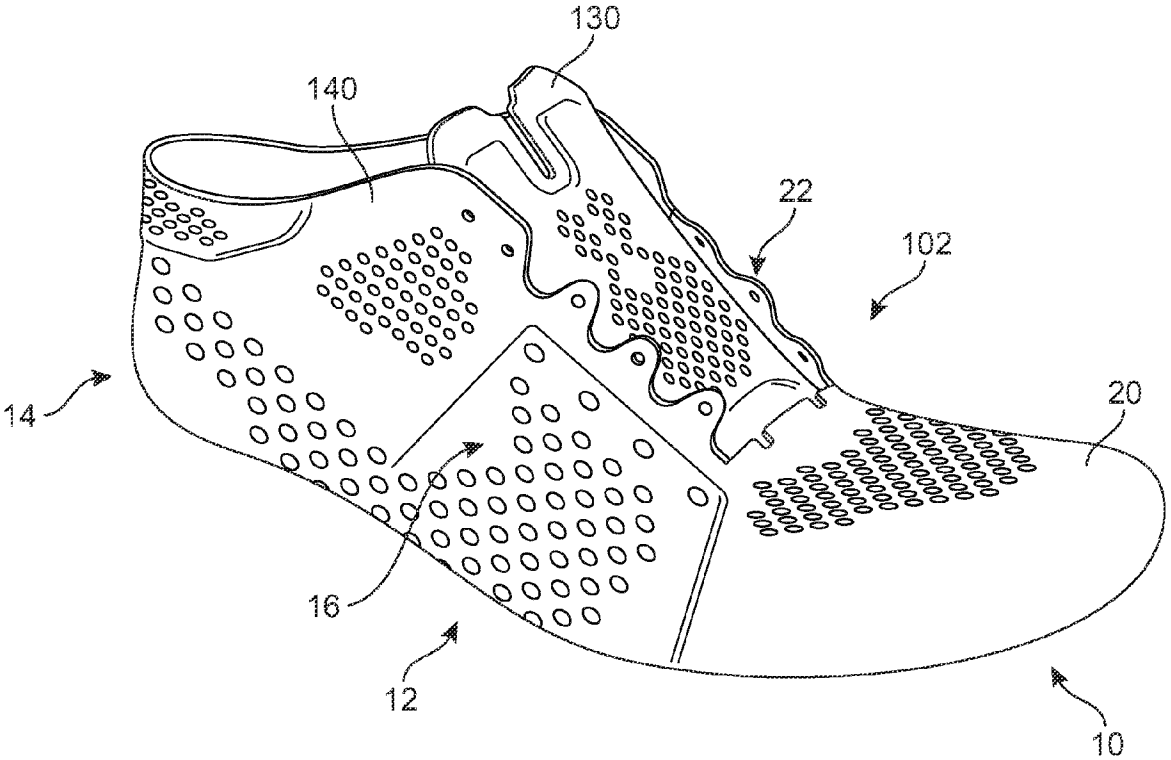
FIG. 2 is a schematic isometric view of an embodiment of a textile upper.
Figure 3:
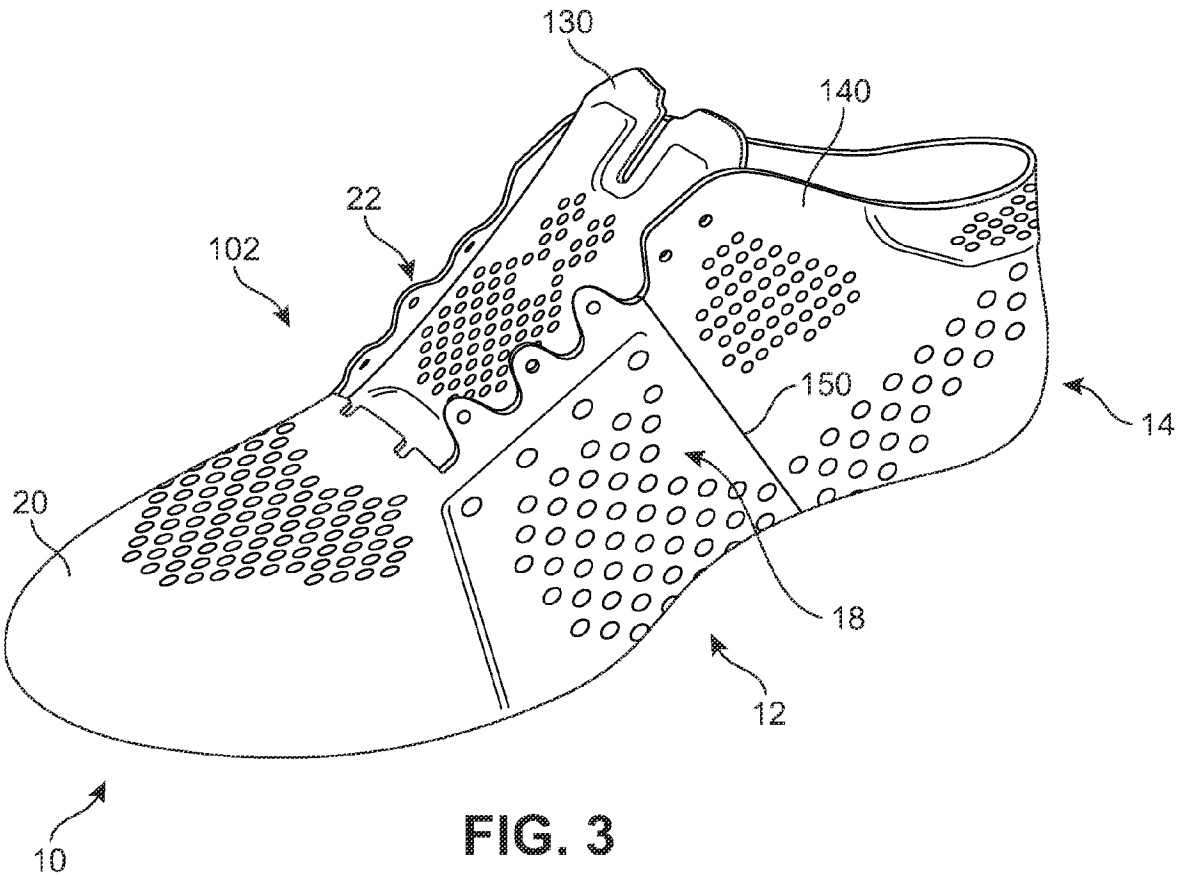
FIG. 3 is another schematic isometric view of the textile upper of FIG. 2.
Figure 4:
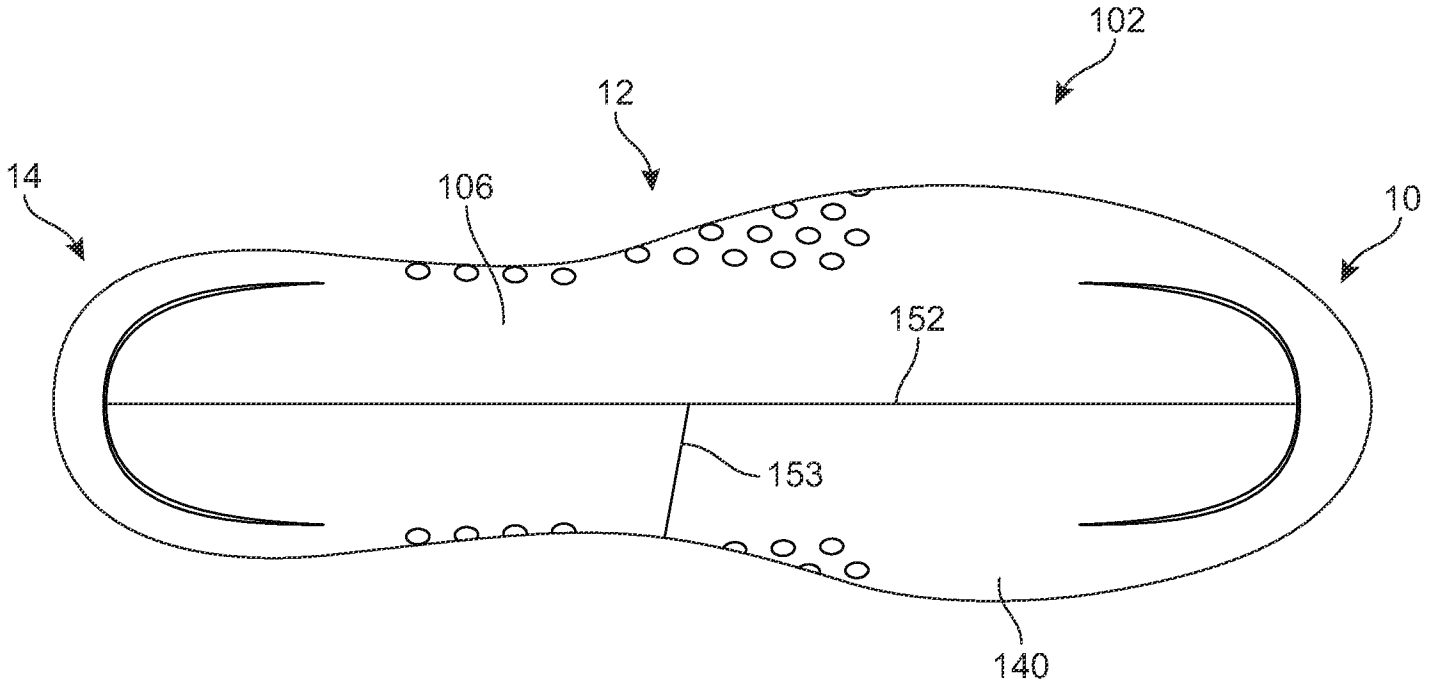
FIG. 4 is a bottom view of the textile upper of FIG. 2.

FIGS. 2 through 4 illustrate various views of upper 102. For purposes of clarity, sole structure 110 is not shown. Moreover, it will be understood that some embodiments may not include a sole structure and instead comprise a bootie-like article with only an upper.

Referring to FIGS. 2 through 4, purposes of reference, upper 102 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, upper 102 may include lateral side 16 and medial side 18. In particular, lateral side 16 and medial side 18 may be opposing sides of upper 102. Furthermore, both lateral side 16 and medial side 18 may extend through forefoot portion 10, midfoot portion 12 and heel portion 14. Some embodiments may further include a toe portion 20 as well as a vamp or instep portion 22.

It will be understood that forefoot portion 10, midfoot portion 12 and heel portion 14 are only intended for purposes of description and are not intended to demarcate precise regions of upper 102. Likewise, lateral side 16 and medial side 18 are intended to represent generally two sides of an article, rather than precisely demarcating upper 102 into two halves.

As mentioned above, upper 102 may be at least partially formed from a knitted component 140. Knitted component 140 comprises an approximately two dimensional construction that is formed or otherwise shaped to extend around the foot. As depicted in FIGS. 2-4, knitted component 140 forms both an outer side (or outer surface) and an inner side (or inner surface) of upper 102.

As discussed in further detail below, knitted component 140 may be formed of a unitary knit construction as a part of a larger knitted textile element. Knitted component 140 is then removed from the larger knitted textile element and various edges of knitted component 140 are secured together to form the shape of upper 102. As various edges of knitted component 140 are joined, various seams may be formed along upper 102. For example, a seam 150 may be formed when adjacent edges of knitted component 140 are joined along medial side 18, as seen in FIG. 3. Likewise, a seam 152 and a seam 153 may be formed when adjacent edges of knitted component 140 are joined along a bottom portion 106 of upper 102, as seen in FIG. 4. In some embodiments, a single knitted textile element may include multiple knitted components, which may be removed to form separate uppers and/or tongues.

Based upon the above discussion, knitted component 140 imparts a variety of features to upper 102. Moreover, knitted component 140 provides a variety of advantages over some conventional upper configurations. As noted above, conventional footwear uppers are formed from multiple material elements (e.g., textiles, polymer foam, polymer sheets, leather, synthetic leather) that are joined through stitching or bonding, for example. As the number and type of material elements incorporated into an upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper. To this end, knitted component 140 forms a substantial portion of upper 102, while increasing manufacturing efficiency, decreasing waste, and simplifying recyclability.

Embodiments can also utilize one or more reinforced portions. The term "reinforced portion" refers to any portion of an upper that incorporates any additional materials within one or more layers of knitted component 140. As described in further detail below, each reinforced portion may comprise separated layers of knitted component 140 that are filled with a reinforcing material, such as an insert member. Accordingly, a reinforced portion may facilitate increased strength and/or reinforcement for the upper, and/or may increase cushioning and comfort, depending on the reinforcing or insert material used.

Figure 5:
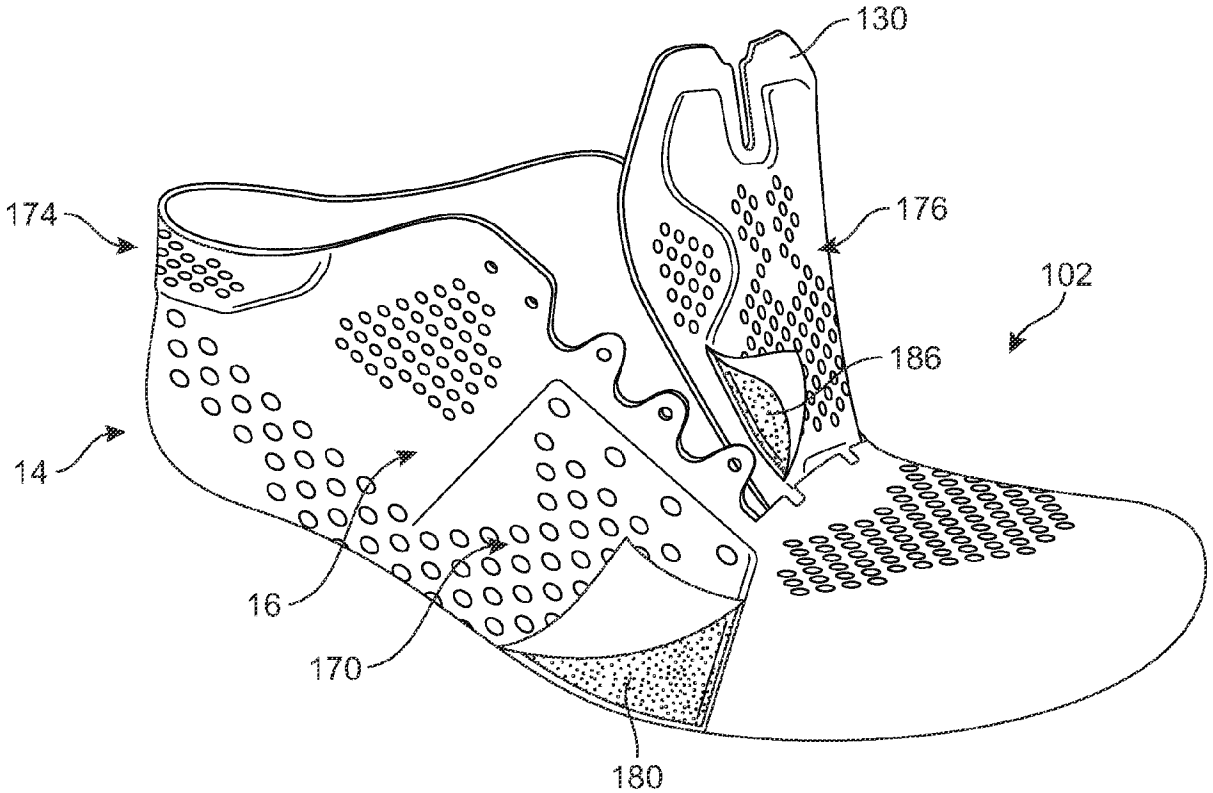
FIG. 5 is a schematic isometric view of an embodiment of a textile upper, in which internal insert members are partially visible in the forefoot and tongue of the upper.
Figure 6:
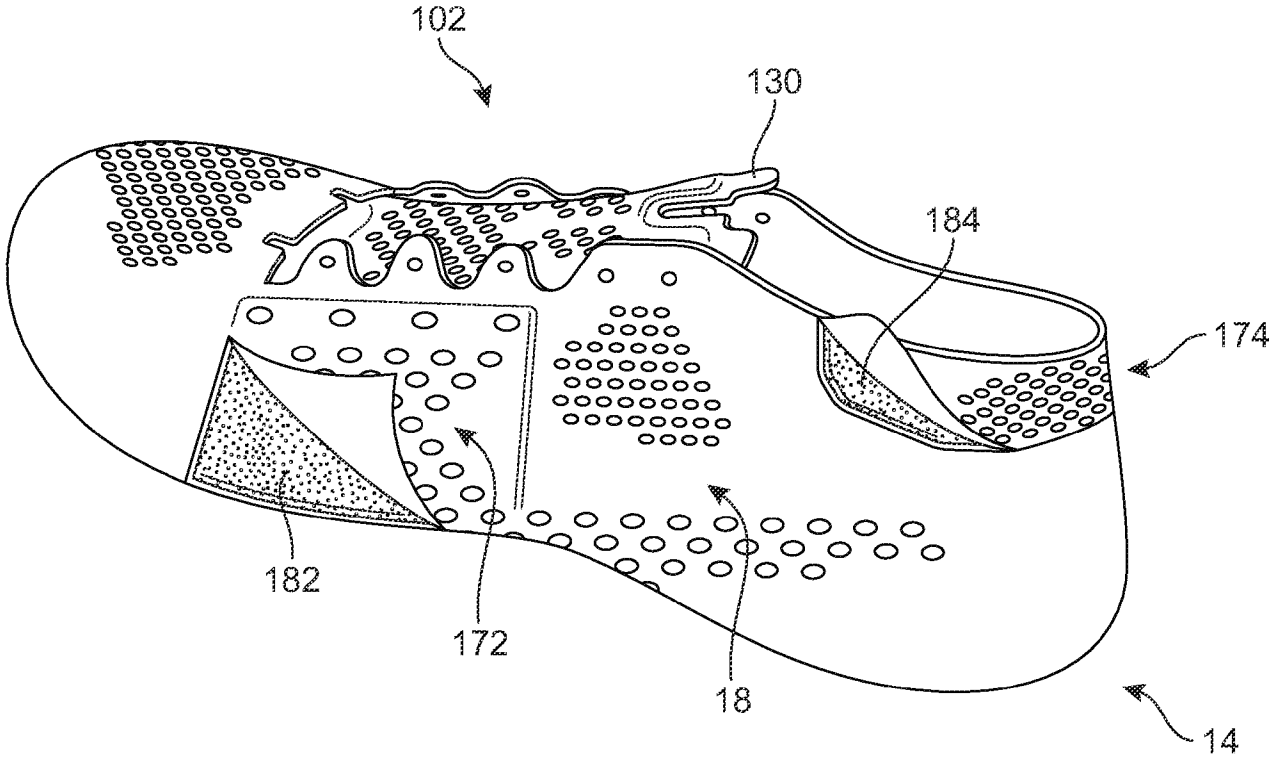
FIG. 6 is a schematic isometric view of an embodiment of a textile upper, in which internal insert members are partially visible in the forefoot and on the heel of the upper.

FIGS. 5 and 6 illustrate schematic views of upper 102 showing four distinct reinforced portions, including first reinforced portion 170, second reinforced portion 172, third reinforced portion 174 and fourth reinforced portion 176. First reinforced portion 170 and second reinforced portion 172 comprise portions of lateral side 16 and medial side 18, respectively, which are associated with forefoot portion 10. Third reinforced portion 174 may be associated with heel portion 14, while fourth reinforced portion 176 may be associated with tongue 130.

For purposes of illustration, each reinforced portion in FIGS. 5 and 6 is seen to be cut open. Moreover, the internal areas (or pockets) of each reinforced portion is seen to include an insert member. In particular, first reinforced portion 170, second reinforced portion 172, third reinforced portion 174 and fourth reinforced portion 176 incorporate first insert member 180, second insert member 182, third insert member 184 and fourth insert member 186. With this arrangement, first reinforced portion 170 and second reinforced portion 172 provide cushioning on the sides of upper 102. Additionally, third reinforced portion 174 provides support on an upper part of heel portion 14, which may act to provide additional padding to the heel and Achilles tendon. Furthermore, fourth reinforced portion 176 provides support on tongue 130, which may act to pad the instep of the foot.

In different embodiments, an insert member could comprise various different materials. Exemplary materials that could be used include, but are not limited to: foams, plastics, as well as other kinds of knitted or textile materials. In some cases, an insert member may be made of a soft and/or resilient material that is configured to provide padding or cushioning to a reinforced portion. In other cases, an insert member maybe made of a rigid and/or inflexible or semi-inflexible material that is configured to provide support or stiffness to a reinforced portion. In still other cases, various insert members may be made of various materials configured to provide specific desired properties to a reinforced portion. The type of insert used could be selected according to factors including location on upper 102, the type of footwear, intended use as well as possibly other factors.

Figure 7:
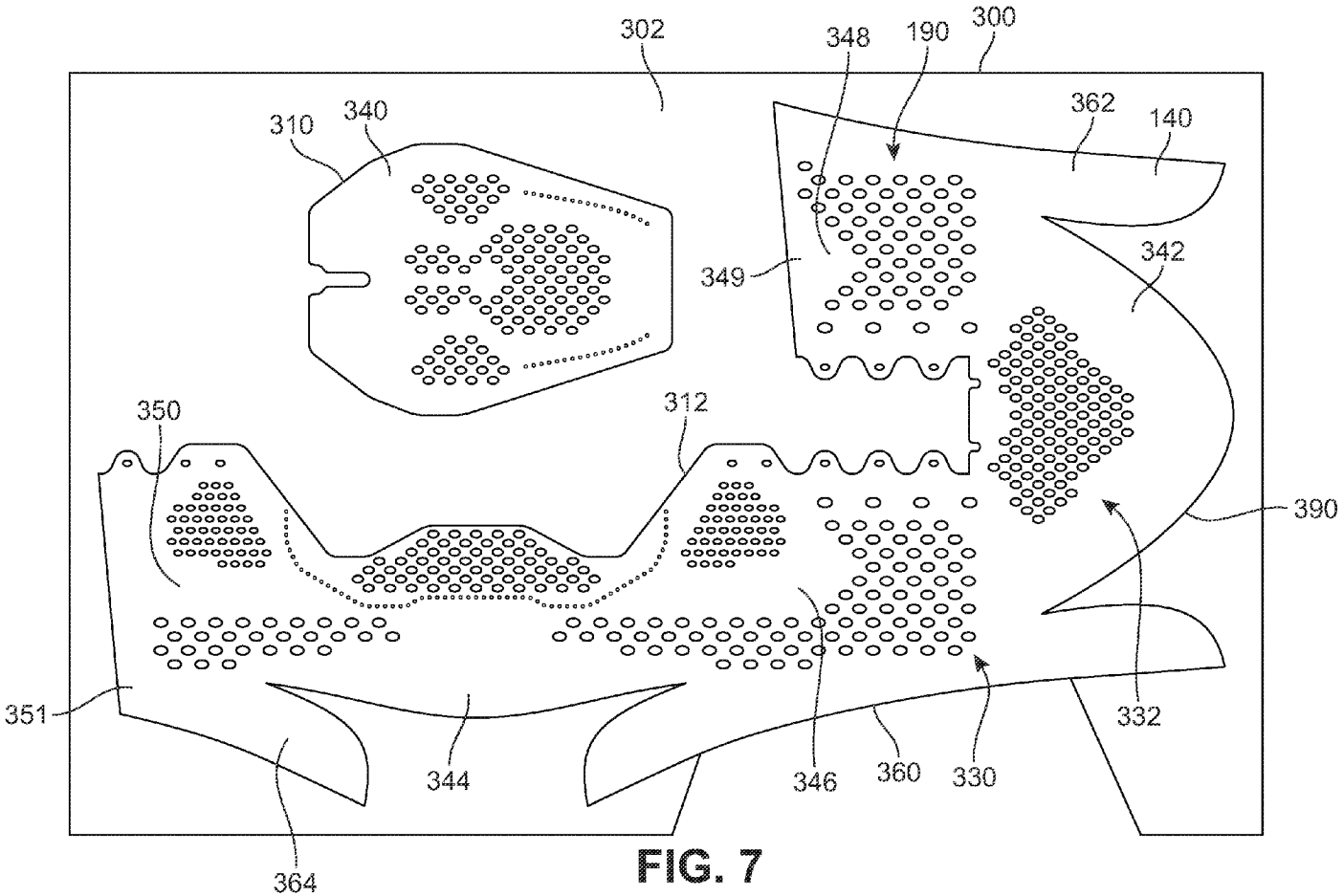
FIG. 7 is a plan view of a knitted textile element incorporating material sections that can be used to make an upper.
Figure 8:
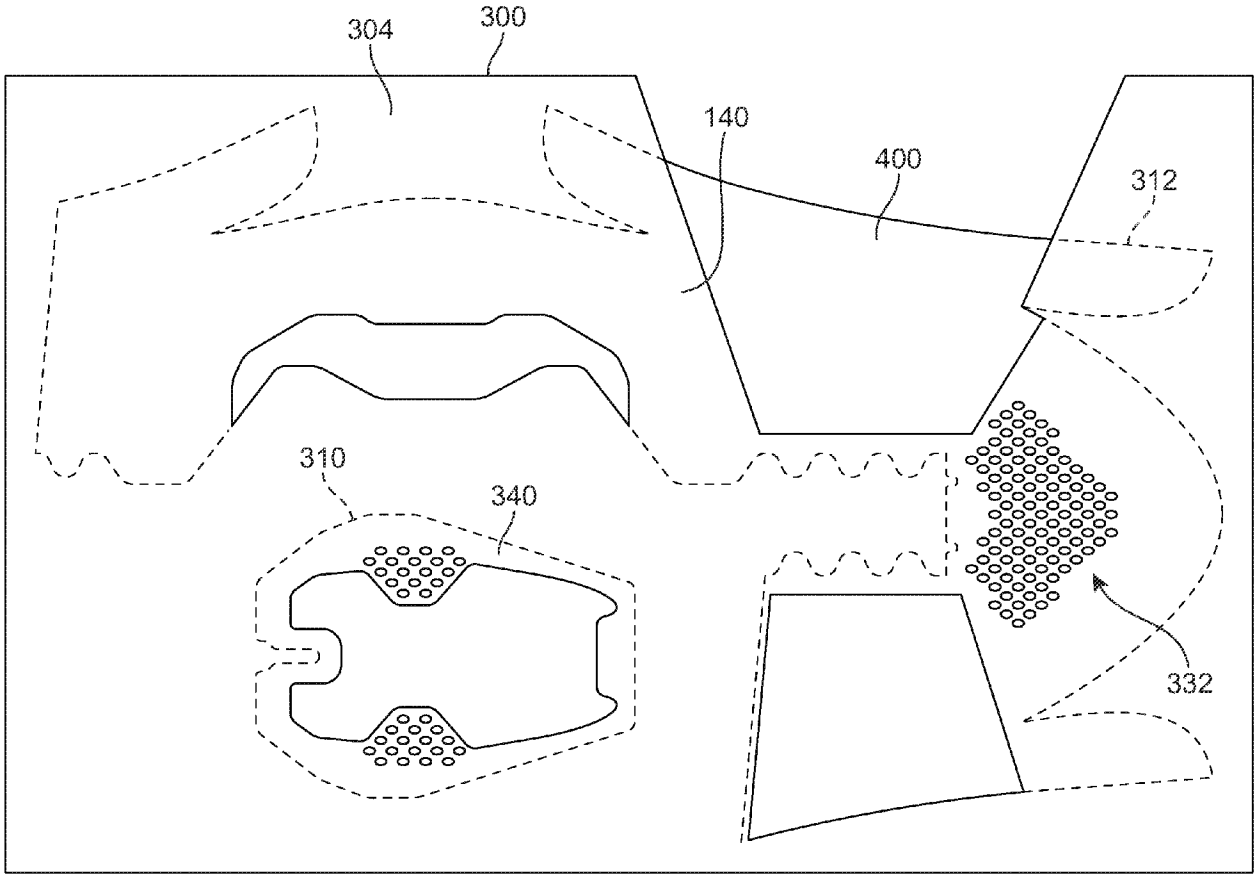
FIG. 8 is a view of an opposing side of the knitted textile element of FIG. 7.

FIGS. 7 and 8 illustrate schematic views of an embodiment of an outer side 302 and an inner side 304, respectively, of a pre-cut knitted textile element 300. In this configuration, outer side 302 is seen to be a top side of knitted textile element 300, while inner side 304 is seen to be a bottom side of knitted textile element 300. Referring to FIGS. 7 and 8, knitted textile element 300 comprises a textile material from which knitted component 140 may be cut out. As best seen in FIG. 7, a first outer periphery 310 of knitted component 140 bounds a section of material corresponding to a knitted tongue 130, while a second outer periphery 312 of knitted component 140 bounds the remaining portions that form knitted upper 102. For purposes of illustration, the locations of first outer periphery 310 and second outer periphery 312 are indicated in phantom on inner side 304, though in some cases these boundaries may not be visible on inner side 304.

Referring to FIG. 7, knitted component 140 may comprise various portions that correspond to portions or regions of the finished upper 102 shown in FIGS. 1 through 6. For example, pre-cut tongue section 340 is seen to correspond directly to tongue 130. Further, a forefoot section 342 and a heel section 344 correspond to the forefoot portion 10 and heel portion 14, respectively, of upper 102 (see FIGS. 1-6). Likewise, lateral side section 346 corresponds to a portion of upper 102 seen on lateral side 16. To achieve the flattened configuration for knitted component 140, some portions of material that are adjacent in the formed upper have been separated in the flattened configuration. For example, the medial side 18 of upper 102 has been separated into a first medial section 348 and a second medial section 350. First medial section 348 and second medial section 350 each further include a first edge 349 and a second edge 351, respectively, which may be overlapped and joined together in the final upper 102. The region of overlap and joining therefore corresponds to seam 150 (see FIG. 3). In a similar manner, bottom portion 106 of upper 102 is separated into disjoint sections in this flattened configuration. In particular, a first bottom section 360 is associated with a first half of bottom portion 106 of upper 102 (see FIG. 4). Additionally, a second bottom section 362 and a third bottom section 364 are joined with each other and with first bottom section 360 to form the remaining half of bottom portion 106 of upper 102. Together, first bottom section 360, second bottom section 362 and third bottom section 364 are joined together on bottom portion 106 and form seam 152 and seam 153 (see FIG. 4).

In the configuration of FIGS. 7 and 8, knitted textile element 300 (and, accordingly, knitted component 140) has a flat generally two-dimensional configuration that comprises one or more yarns knitted together. Moreover, knitted textile element 300 (and knitted component 140) may be formed of unitary knit construction. As used herein and in the claims, a knitted component is defined as being formed of "unitary knit construction" when formed as a one-piece element through a knitting process. That is, the knitting process substantially forms the various features and structures of a knitted component without the need for significant additional manufacturing steps or processes. A unitary knit construction may be used to form a knitted component having structures or elements that include one or more courses or wales of yarn or other knit material that are joined such that the structures or elements include at least one course or wale in common (i.e., sharing a common yarn) and/or include courses or wales that are substantially continuous between each of the structures or elements. With this arrangement, a one-piece element of unitary knit construction is provided.

In general, yarn is defined as an assembly having a substantial length and relatively small cross-section that is formed of at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed of a single filament, which is conventionally referred to as a monofilament yarn, or a plurality of individual filaments grouped together. Yarn may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

Knitted component 140 may incorporate various types of yarn that impart different properties to separate areas of upper 102 and/or tongue 130. That is, one area of knitted component 140 may be formed from a first type of yarn that imparts a first set of properties, and another area of knitted component 140 may be formed from a second type of yarn that imparts a second set of properties. In this configuration, properties may vary throughout upper 102 and/or tongue 130 by selecting specific yarns for different areas of knitted component 140. The properties that a particular type of yarn will impart to an area of knitted component 140 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for knitted component 140 may affect the properties of upper 102 and/or tongue 130. For example, a yarn forming knitted component 140 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 102 and/or tongue 130. Accordingly, both the materials forming the yarn and other aspects of the yarn may be selected to impart a variety of properties to separate areas of upper 102 and/or tongue 130.

In some embodiments, knitted textile element 300 (and therefore knitted component 140) may be formed from one or more yarns that are mechanically-manipulated through either an interweaving, intertwining and twisting, or interlooping process, for example. For purposes of this description, interweaving is the intersection of two yarns that cross and interweave at right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping. Knitted textile element 300 may, therefore, be formed from one of these processes for manufacturing a textile. However, in other embodiments any other methods for manufacturing knitted textile element 300 could be used.

A variety of mechanical processes have been developed to manufacture a textile. In general, the mechanical processes may be classified as either warp knitting or weft knitting. With regard to warp knitting, various specific sub-types that may be utilized to manufacture a textile include tricot, raschel, and double needle-bar raschel (which further includes jacquard double needle-bar raschel). With regard to weft knitting, various specific sub-types that may be utilized to manufacture a textile include circular knitting and flat knitting. Various types of circular knitting include sock knitting (narrow tube), body garment (seamless or wide tube), and jacquard.

In some embodiments, knitted textile element 300 may be manufactured using a warp knitting process. In other words, in some embodiments, knitted textile element 300 and therefore knitted component 140 may comprise a warp knitted textile element or material (e.g., knitted component 140 may be a warp knitted component). Using a warp knitted textile element may help reduce the tendency of the periphery or exposed edges of knitted component 140 to unravel after knitted component 140 has been cut from knitted textile element 300. In an exemplary embodiment, knitted textile element 300 may be formed of unitary knit construction through a warp knitting process and may include one or more knitted components, including one or more uppers and/or tongues, formed together on the same knitted textile element 300.

In an exemplary embodiment, knitted textile element 300 can be manufactured using different yarns to form outer side 302 and inner side 304. By using distinct yarns on outer side 302 and inner side 304, knitted textile element 300 can be manufactured to have different knitting configurations on outer side 302 and inner side 304. For example, in some cases, the particular configuration of yarns on outer side 302 may be different from the configuration of yarns on inner side 304. These differences can include, but are not limited to, one or more of: differences in knitting patterns, differences in knitted structures, differences in types of yarn used, differences in colors of yarns used, and/or differences in the material properties of yarns used (e.g., different materials to provide a softer inner side and a durable outer side).

In some embodiments, a knitting configuration for outer side 302 may be provided to impart a greater degree of durability, strength, and/or wear or abrasion resistance to outer side 302 of knitted component 140. For example, a yarn having a heavier denier or being made of a stronger or more durable material may be used for the knitting configuration on outer side 302 to provide a greater degree of durability, strength, and/or wear or abrasion resistance. Similarly, in some embodiments, a knitting configuration for inner side 304 may be provided to impart a greater degree of comfort or softness so as to serve as an interior lining of the upper. For example, a yarn having a lighter denier or being made of a softer or more comfortable material may be used for the knitting configuration on inner side 304 to provide a greater degree of comfort or softness. With a desired selection of knitting configurations for each of an outer side and an inner side on a knitted component, desired characteristics may be selectively provided to the upper.

Figure 9:
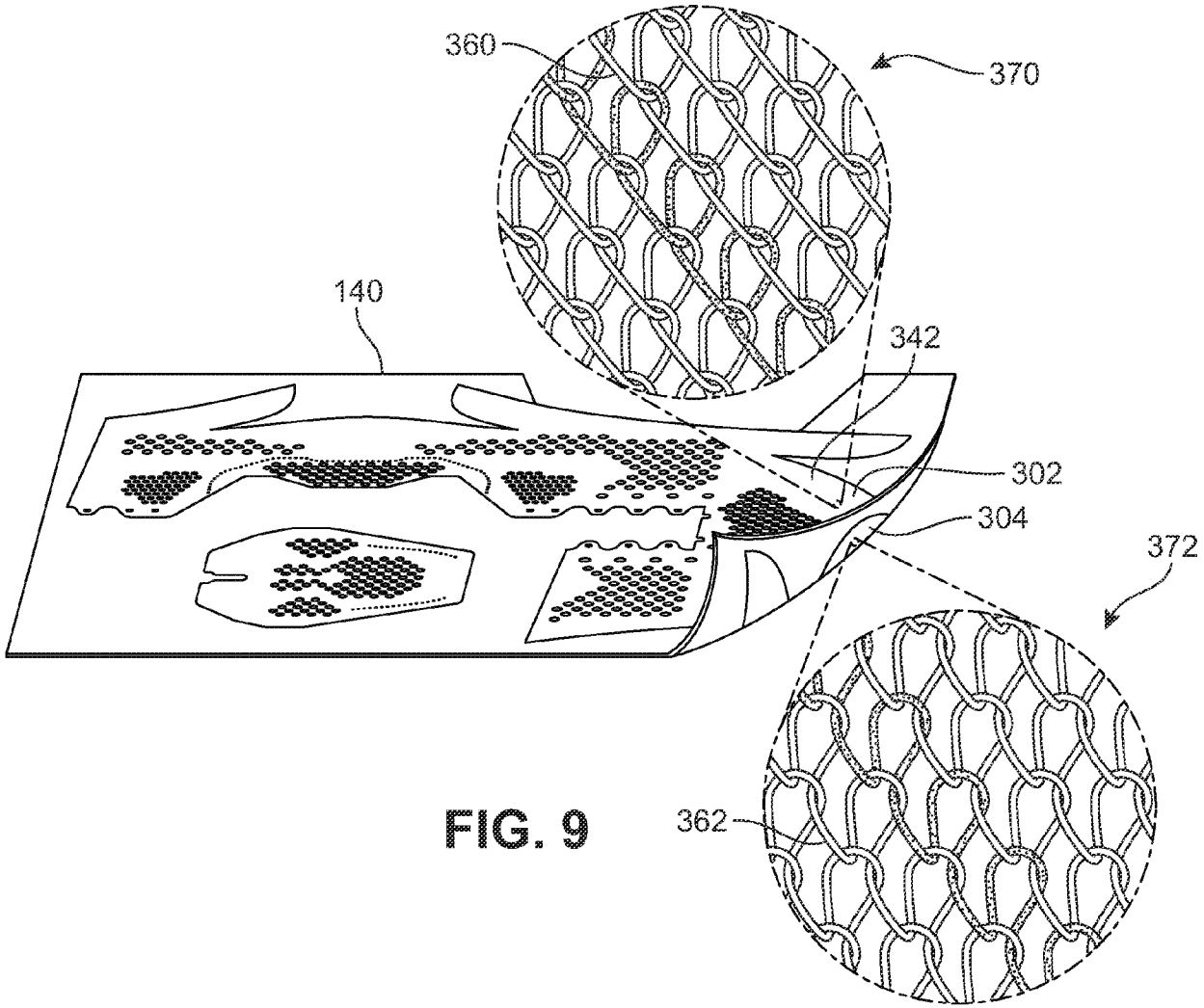
FIG. 9 is a schematic view of the knitted textile element of FIG. 7, in which the knitting pattern of the outer side and the inner side are shown in detail.

FIG. 9 illustrates a schematic isometric view of knitted component 140, in which portions of outer side 302 and inner side 304 are both visible. For purposes of illustration, a portion 370 of outer side 302 and a portion 372 of inner side 304 have been enlarged to highlight the differences in yarn structure on each side. Here, portion 370 and portion 372 are adjacent to one another and both comprise portions of the more general forefoot section 342. As seen in the enlarged views of each portion, outer side 302 may comprise first set of yarns 360, which have a first knitted configuration, while inner side 304 may comprise second set of yarns 362, which have a second knitted configuration. First set of yarns 360 may be distinct from second set of yarns 362. Moreover, the first knitted configuration is seen to be substantially different from the second knitted configuration. The knitting configurations shown here are only intended to be exemplary and in different embodiments any other kinds of variations in the knitting configurations could be used between first set of yarns 360 and second set of yarns 362.

Although some portions of knitted component 140 may have substantially different knitted configurations on an outer side and an inner side, other portions could have substantially similar knitted configurations on the outer side and the inner side. Moreover, differences in the knitted configuration can vary across knitted component 140 along both outer side 302 and inner side 304. In other words, variations in the knitting configuration or style may vary over different portions of the same side, as well as between different sides. The differences in knitting configurations could comprise any variations in knitting configurations or knitting constructions known in the art.

In some embodiments, this configuration allows for the use of different yarn types on outer side 302 and inner side 304. By modifying the knitting configurations and/or types of yarns used between outer side 302 and inner side 304, this may allow for a variations in the structural characteristics of outer side 302 and inner side 304. Examples of such differences are discussed in further detail below. It will also be understood that in some embodiments, the types of yarns used on each side could be substantially similar.

As previously mentioned, knitted component 140 may be formed of unitary knit construction within the larger knitted textile element 300 prior to being cut away from the excess material of knitted textile element 300. For purposes of clarity, the discussion below focusses on the material and structural properties (including knitting configuration and composition of materials) of knitted component 140, as this is the portion of knitted textile element 300 eventually used to make upper 102. However, it will be understood that the various properties discussed could also apply to knitted textile element 300 as a whole, including some portions of knitted textile element 300 that may be separated from knitted component 140. Moreover, the terms outer side 302 and inner side 304 are used to refer to the opposing sides of both knitted textile element 300 as well as knitted component 140.

In different embodiments, the material and/or structural properties of opposing sides of knitted component 140 may vary. As one possible example, outer side 302 may be configured with higher durability and less elasticity than inner side 304. In some embodiments, these material properties could be achieved by using yarns for outer side 302 that have greater intrinsic durability and less elasticity than the yarns used for inner side 304. In other embodiments, these material properties could be achieved by utilizing distinct knitting patterns or knitting configurations on outer side 302 and inner side 304. In still other embodiments, these material properties could be achieved using a combination of different kinds of yarns for outer side 302 and inner side 304, in combination with different knitting patterns or configurations. Such an exemplary configuration that has greater durability on outer side 302 and more elasticity on inner side 304 may allow for the formed upper to provide increased protection on the outside and increased comfort and flexibility on the inside. Of course, it will be understood that durability and elasticity are only two exemplary properties and other embodiments could be designed to incorporate a variety of different material and structural properties that differ between outer side 302 and inner side 304 of knitted component 140. Other exemplary properties that could be modified by varying yarn types and knit types between outer side 302 and inner side 304 include, but are not limited to: rigidity, porousness, elasticity along a specified direction, color, texture, traction or frictional properties, cushioning, energy return as well as possibly other properties.

The ability to manufacture outer side 302 and inner side 304 from different yarns may also facilitate the introduction of various macro knitting features. For example, some embodiments may incorporate various holes or apertures along some portions of knitted component 140. In some embodiments, some of these holes may be associated with either outer side 302 or inner side 304, but not both. As an example, knitted component 140 may be configured with a plurality of holes 190. Plurality of holes 190 may include various different groupings of holes associated with different regions of knitted component 140, including, for example, sections of knitted component 140 corresponding to forefoot portion 10, midfoot portion 12, heel portion 14, toe portion 20 and/or instep portion 22 of upper 102 (see FIG. 1). Additionally, as seen in comparing FIGS. 7 and 8, some groupings of holes may extend through both outer side 302 and inner side 304, while others may only be associated with one side. In this context, plurality of holes 190 could form a mesh knit structure in various portions of upper 102. Such a mesh knit structure could be varied in different embodiments according to differences in the sizes of the holes, the numbers of holes used and their arrangement. As an example of the different hole arrangements, first group of holes 330 is disposed on outer side 302 of lateral side section 346 but does not extend through to inner side 304. In contrast, second group of holes 332 in forefoot section 342 may extend through both outer side 302 and inner side 304. Such a configuration in which some holes extend through the entire thickness of knitted component 140, while others extend only partially through (i.e., on the top or bottom side), is made possible by the use of different yarns to form outer side 302 and inner side 304.

The embodiments depict a particular configuration, including size, shape, groupings and locations for various holes of plurality of holes 190. It will be understood that this configuration is only exemplary and other embodiments could utilize a variety of different configurations of holes. The number, size, shape, grouping and locations for various holes could be selected to vary breathability as well as material properties such as elasticity and/or durability. Furthermore, the use of holes that are disposed in an outer side but not an inner side (or vice versa) of portions of an upper may be used to more finely control aspects of breathability and/or other material properties.

Embodiments can include provisions for separating the outer and inner side of a knitted textile element so that a space or pocket is formed between the outer and inner sides. Moreover, this separation of the outer side and inner side can be achieved locally at selected locations of the textile element, thereby provide effectively two layers in some portions of the textile element while the remaining portions are comprised of a single layer.

Figure 10:
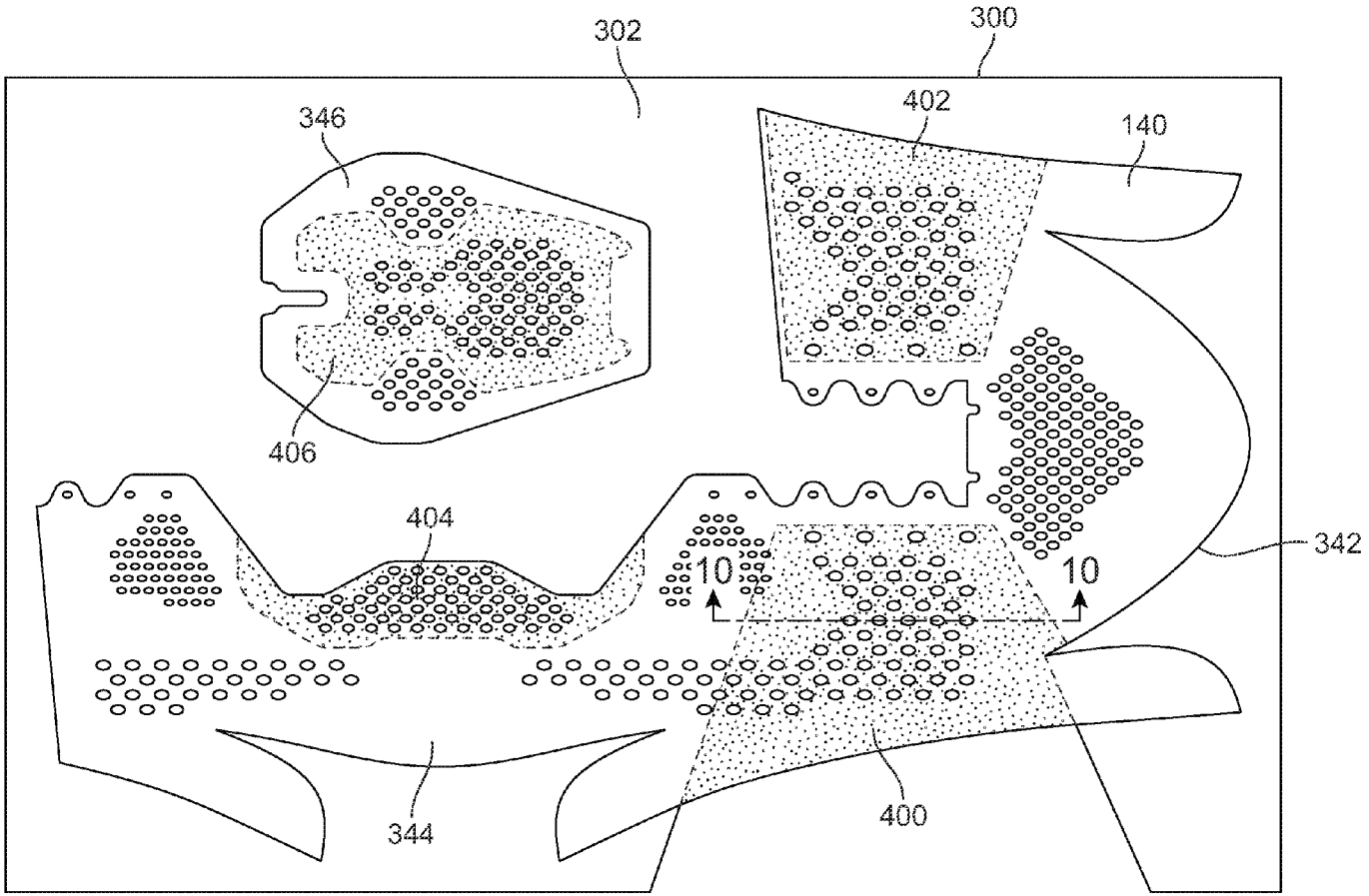
FIG. 10 is a plan view of the knitted textile element of FIG. 7, in which various separated portions of the knitted textile element are highlighted.
Figure 11:
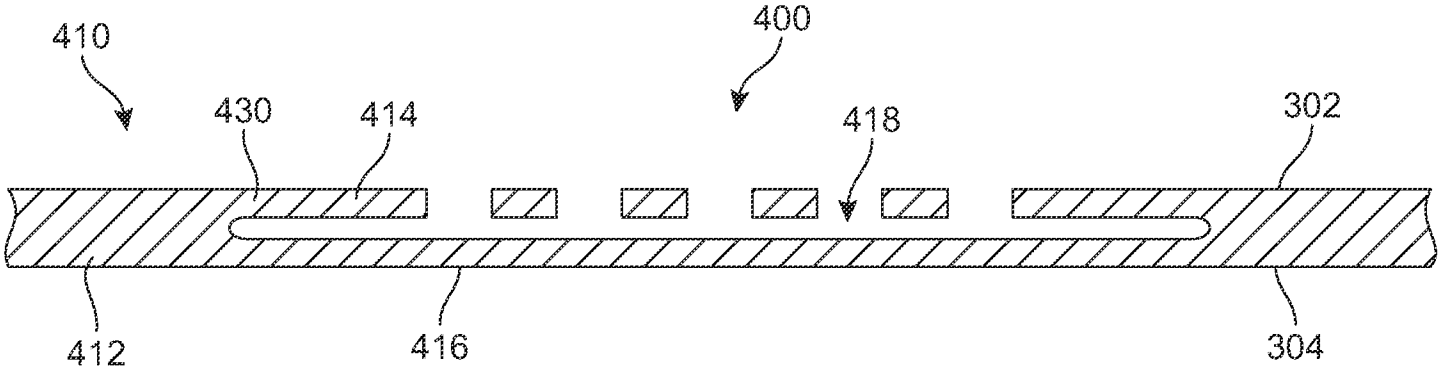
FIG. 11 is a schematic cross-sectional view of a separated portion of the knitted textile element of FIG. 9.

FIGS. 10 and 11 illustrate a plan view of an embodiment of knitted textile element 300 and a cross-sectional view of a portion of knitted textile element 300, respectively. Referring to FIGS. 10 and 11, knitted component 140 can be configured with separated portions. Each separated portion may comprise a portion where outer side 302 and inner side 304 have been separated into two distinct layers. Moreover, each separated portion is further associated with a pocket or cavity disposed between the separated sides.

In some embodiments, knitted component 140 may include a first separated portion 400, a second separated portion 402, a third separated portion 404 and a fourth separated portion 406. For purposes of illustration, each separated portion is shaded in FIG. 10, though in some embodiments the area of each separated portion may not be visible by looking directly at outer side 302 of textile element 300. Each separated portion may be associated with a particular location on knitted component 140. For example, first separated portion 400 and second separated portion 402 may be associated with opposing sides of forefoot section 342. Likewise, third separated portion 404 may be associated with heel section 344. Finally, fourth separated portion 406 may be associated with tongue section 346.

As seen in FIG. 11, knitted component 140 may generally transition from a single layer of material to separable layers at first separated portion 400, which is shown in cross-section in FIG. 11. Specifically, a first portion 410 of knitted component 140 that is disposed adjacent to first separated portion 400 has a single layer construction 412, in which outer side 302 and inner side 304 are joined. In contrast, the portion of knitted component 140 comprised of first separated portion 400 has a dual layer construction, including a first layer 414 and a second layer 416. Moreover, within first separated portion 400, outer side 302 of knitted component 140 is associated with first layer 414 while inner side 304 of knitted component 140 is associated with second layer 416. This creates a pocket or cavity, indicated in FIG. 11 as cavity 418. The transition between the single layer construction of first portion 410 and the double layer construction of first separated portion 400 occurs at a transition region 430.

It will be understood that both first portion 410, which is constructed as a single layer, and first separated portion 400, which is constructed as a double layer, may be comprised of the same collections of yarns. Thus the single layer construction is achieved by knitting the collection of yarns together so that outer side 302 and inner side 304 are inseparable or locked, while the double layer construction is achieved by knitting the collection of yarns into two separable layers. As already described above, the two separable layers may comprise distinct groups of yarns that together form the full collection of yarns.

Using this configuration of unitary knit construction, a continuous transition is maintained between portions having a single layer construction (e.g., first portion 410) and portions having a double layer construction (e.g., first separated portion 400). In some embodiments, outer side 302 of first portion 410 is formed of unitary knit construction with first layer 414 of first separated portion 400. Likewise, in some embodiments, inner side 304 of first portion 410 is formed of unitary knit construction with second layer 416 of first separated portion 400.

It will be understood that the remaining separated portions (second separated portion 402, third separated portion 404 and fourth separated portion 406) may have substantially similar constructions to first separated portion 400. Specifically, in some embodiments, each separated portion may have a substantially similar double layer construction which is adjacent to portions having a single layer construction.

In some embodiments, one or more separated portions may comprise knitted layers having distinct structural and/or material properties. In some embodiments, for example, a first layer of a separated portion may differ from a second layer of the separated portion in terms of yarn types and/or knitted configuration. As one example, in the exemplary configuration first separated portion 400 has a first knitted configuration along outer side 302, which corresponds to first layer 414 of first separated portion 400. In contrast, first separated portion 400 has a second knitted configuration along inner side 304, which corresponds to second layer 416 of first separated portion 400 (see FIG. 8). In this exemplary embodiment, the first knitted configuration of first layer 414 may be substantially different from the second knitted configuration of second layer 416. In a similar manner, each of the remaining separated portions may be comprised of two layers having different knitted configurations.

In order to provide guidance in cutting or otherwise separating sections of material, embodiments can include one or more knitted indicating portions. The term "knitted indicating portion" as used throughout this detailed description and in the claims refers to any knit structure that provides visual indication of boundaries or locations where cutting, separating or similar manipulations of the material must be performed. In contrast to visual indicators that may be applied after a textile has been formed, such as using inks or other colorants, a knitted indicating portion comprises an indicator that is knitted directly into a textile at the time of manufacturing the textile. Exemplary indicators could include, but are not limited to lines and/or perforations, as well as regions having any other different knitted patterns or configurations that stand out visually from the surrounding material. As one particular example, some embodiments of knitted textile element 300 may utilize a knitted boundary line 390 (shown schematically in FIG. 7) to visually indicate the approximate boundary of knitted component 140. Thus, knitted boundary line 390 comprises a knitted indicating portion that guides the process of cutting the correct pattern for knitted component 140 from knitted textile element 300.

Figure 12:
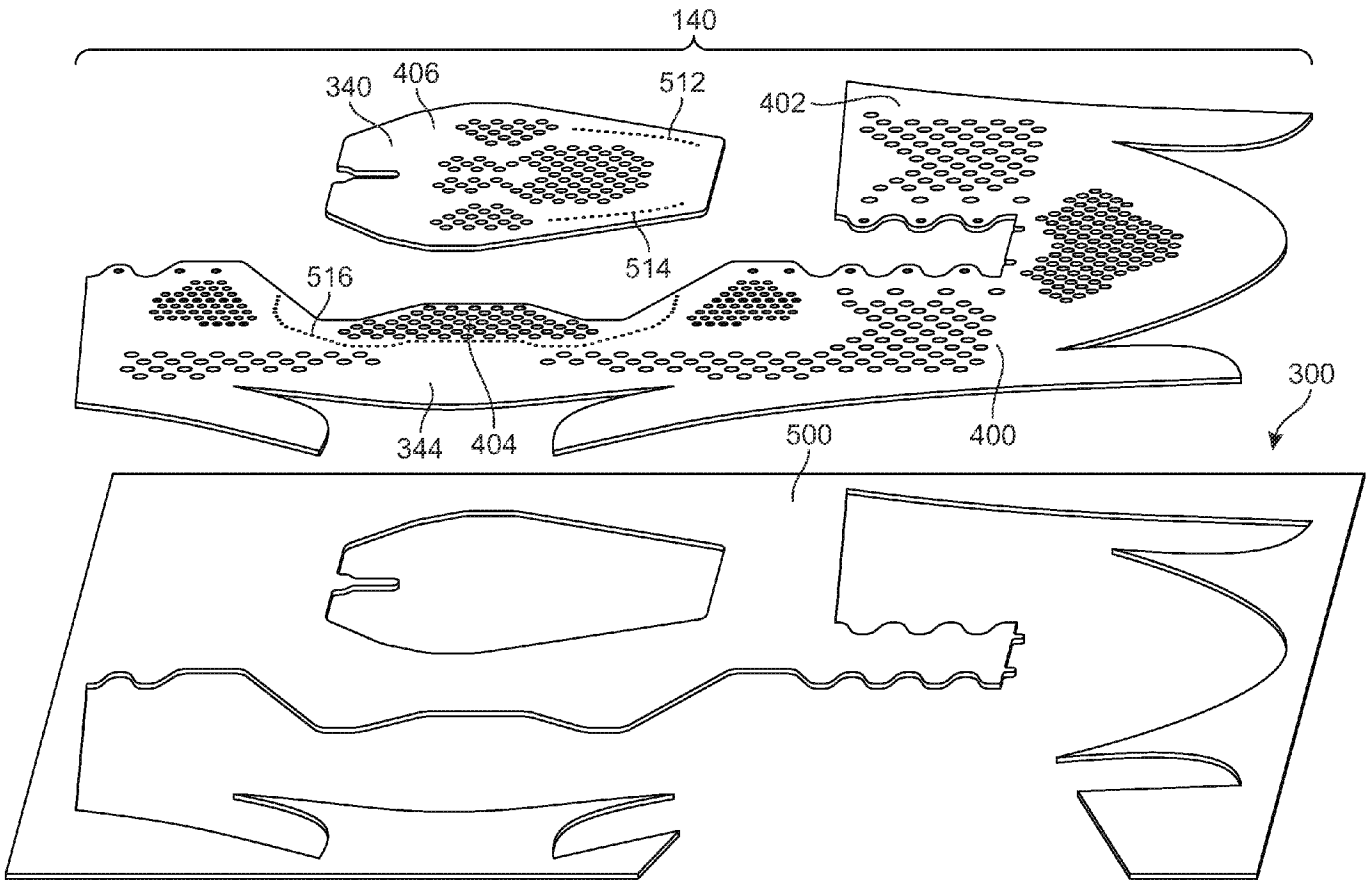
FIG. 12 is a schematic isometric view of an embodiment of a knitted component being cut from excess material of a knitted textile element.

Still another kind of knitted indicating portion can be used to provide visual guidance for cutting open one or more separated portions. As seen in FIG. 12, some embodiments of knitted component 140 may include one or more perforations that facilitate the opening of separated portions. These perforations may serve as a knitted indicated portion.

In some embodiments, knitted component 140 may include a first set of perforations 512 and a second set of perforations 514 on tongue section 340. First set of perforations 512 and second set of perforations 514 correspond to fourth separated portion 406. In some embodiments, knitted component 140 may also include third set of perforations 516 on heel section 344. Third set of perforations 516 may correspond to third separated portion 404. In some cases, perforations could be optional. In addition, some separated portions may be opened along the outer edges of knitted component 140. For example, first separated portion 400 and second separated portion 402 may be opened along peripheral edge 520 of knitted component 140, which can be seen in FIG. 13.

In some embodiments, a knitted indicating portion may be disposed at or near a boundary between a portion having a single layer construction and a portion having a double layer construction (i.e., a separated portion). For example, comparing FIG. 12 with FIG. 10, it may be seen that third set of perforations 516 are disposed along the edge of third separated portion 404, which is a location where knitted component 140 transitions from a single layer construction to a double layer construction. However, in other embodiments, a knitted indicated portion may not be disposed on the boundary between different portions and could be disposed in the middle (or any other location) of a separated portion, for example.

Additionally, in some embodiments, a knitted component may include an edge of a separated portion that corresponds to an outer periphery of the knitted component. With this configuration, removing the knitted component from the knitted textile element by cutting along an outer periphery of the knitted component may both remove the knitted component from the knitted textile element and open one or more separated portions to receive various insert materials. For example, in an exemplary embodiment, one or more separated portions, including first separated portion 400, second separated portion 402, third separated portion 404 and/or fourth separated portion 406, may be configured to transition from a single layer to a dual layer construction along one or more of first outer periphery 310 and/or second outer periphery 312. With this arrangement, when knitted component 140 is removed from knitted textile element 300, one or more of first separated portion 400, second separated portion 402, third separated portion 404 and/or fourth separated portion 406 may also be opened to receive an insert in a single removing or cutting step (for example, through a die cutting process).

FIGS. 12 through 17 illustrate various schematic views of parts of a process in forming an article of footwear using knitted component 140. It will be understood that the following steps are exemplary and in some embodiments some steps may be optional. In addition, knitted textile element 300, including knitted component 140, may be formed through a warp knitting process using any suitable warp knitting machine known in the art.

Referring first to FIG. 12, some embodiments can include a step of cutting knitted component 140 from knitted textile element 300. This may be facilitated by cutting along a knitted indicating portion, for example, knitted boundary line 390. Any methods known in the art for cutting textile materials could be used including, but not limited to: cutting blades, cutting dies, scissors, as well as any other methods known in the art. In some embodiments, excess material 500 may be separated from knitted component 140 during the cutting process. This excess material 500 may be discarded, recycled, or used for other purposes.

Next, one or more separated portions can be cut open to prepare the separated portions to receive various insert materials. In an exemplary embodiment, the separated portion may be cut along a knitted indicating portion. For example, in one embodiment this cutting may be facilitated by cutting along one or more of the perforated portions described above. These include first set of perforations 512, second set of perforations 514 and third set of perforations 516.

Figure 13:
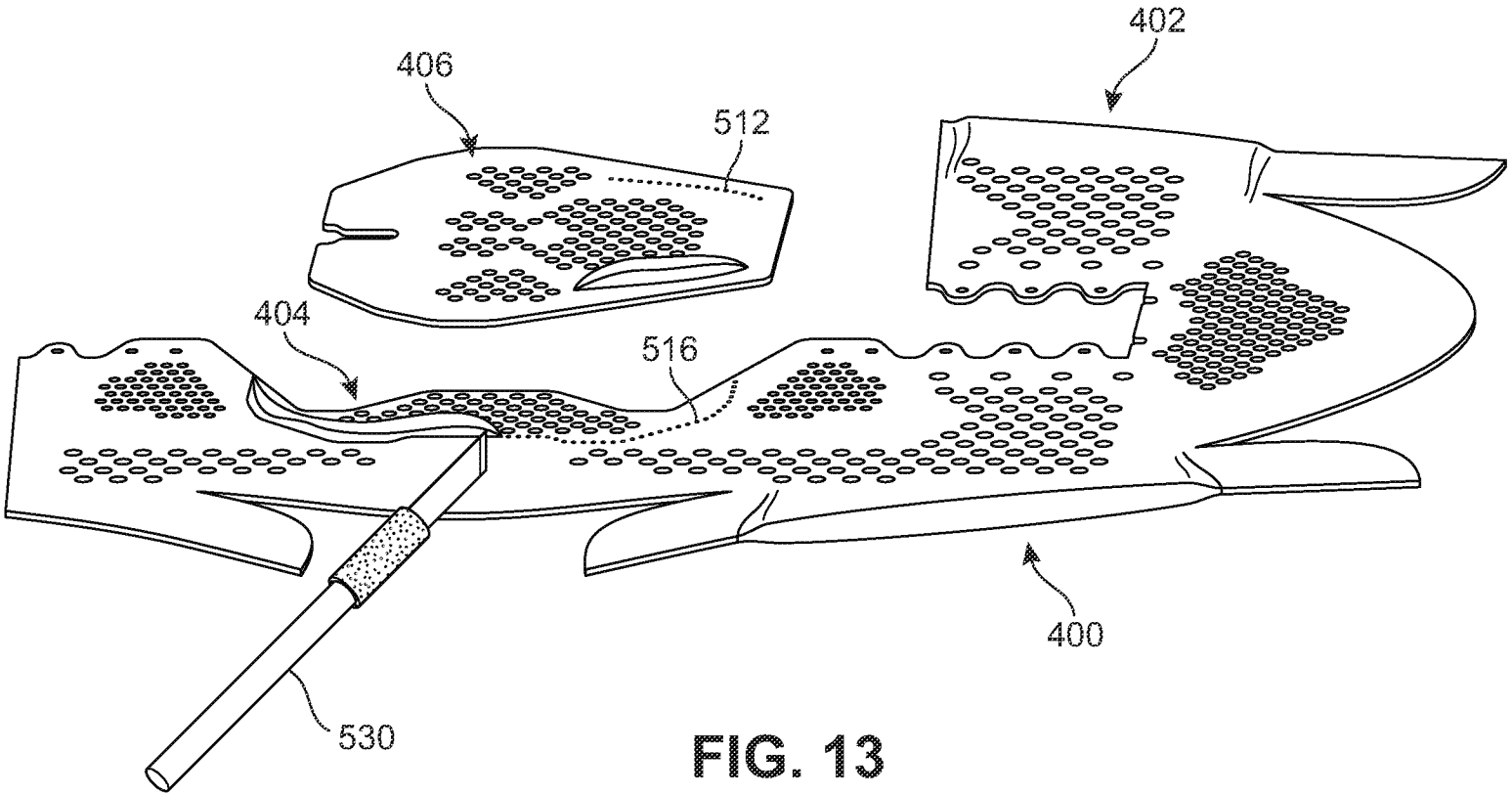
FIG. 13 is a schematic isometric view of an embodiment of a knitted component being cut along various portions corresponding to separated portions.

Referring to FIG. 13, each separated portion can be opened using cutting blade 530. However, in other embodiments, one or more separated portions could be opened using other methods. For example, in some cases, one or more separated portions may be disposed along an outer periphery of the knitted component such that when the knitted component is removed from the knitted textile element, the separated portions are opened. In other cases, separated portions could be manufactured with slots, slits or other openings that provide direct access to the interior pocket without requiring cutting.

Figure 14:
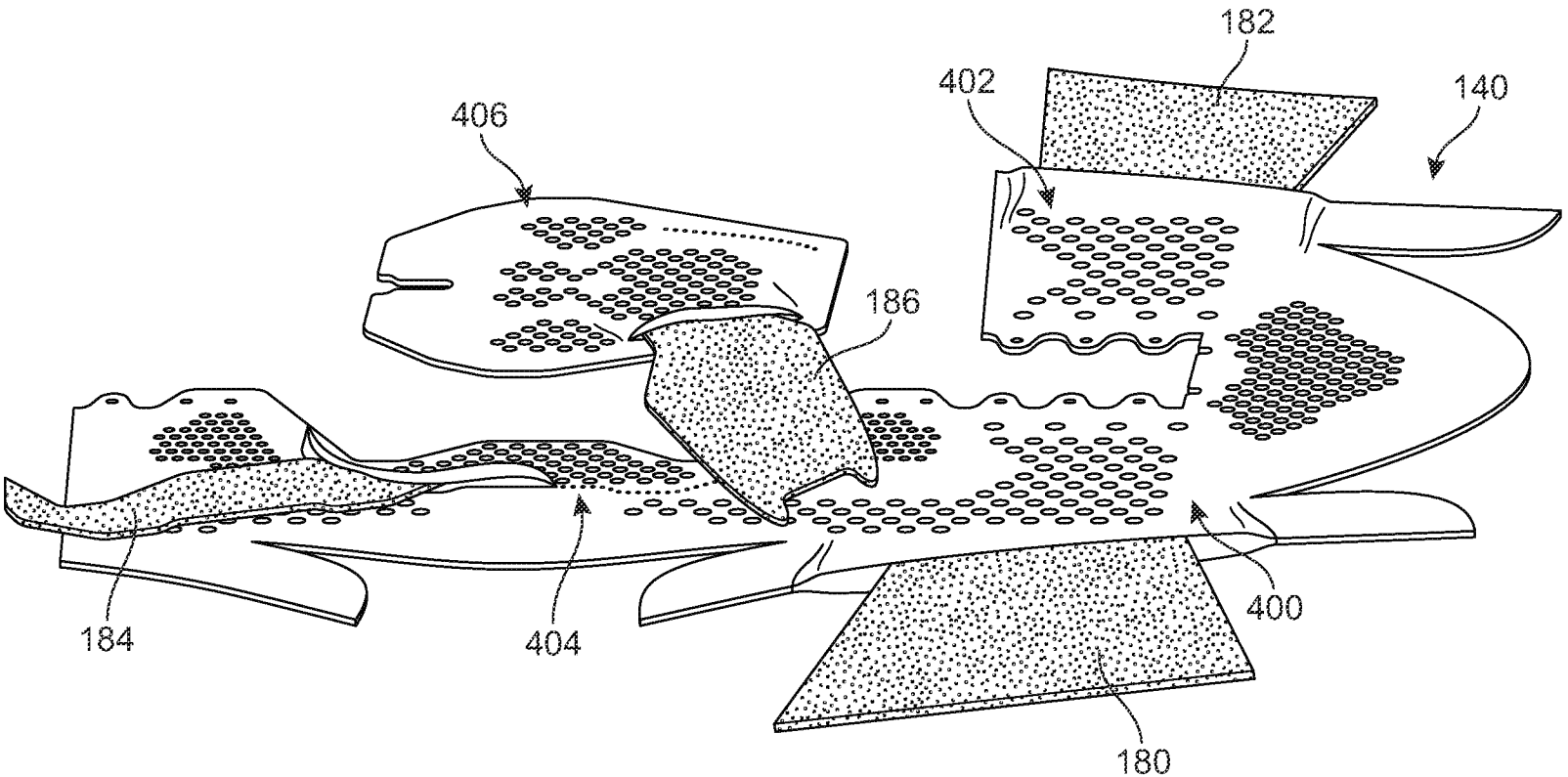
FIG. 14 is a schematic isometric view of an embodiment of insert members being inserted into separated portions.

Referring next to FIG. 14, various insert members or other insert materials could be inserted into each separated portion. For example, first insert member 180, second insert member 182, third insert member 184 and fourth insert member 186 may be inserted into first separated portion 400, second separated portion 402, third separated portion 404 and fourth separated portion 406, respectively.

In one embodiment, provisions may be included to assist with fixing an insert member within the separated portion so as to reduce or prevent movement of the insert member within the separated portion. In some cases, the separated portion may be configured to bond, fuse, or join with itself to surround and close around the insert member within the separated portion to fix the insert member in place. For example, portions of the separated portion may be impregnated with adhesive or other bonding material, such as hot melt adhesive, or may be made using a fusible yarn, so that opposite inside layers of the separated portion may be bonded, heat welded, or joined to each other.

An exemplary fusible yarn that may be used with a knitted component having separated portions, including methods of knitting a knitted component incorporating fusible yarns, is disclosed in Dua et al., U.S. patent application Ser. No. 13/100,689, entitled "Knit Component Bonding", filed on May 4, 2011 and published as U.S. Patent Application Publication No. 2012/0279260 on Nov. 8, 2012, which application is hereby incorporated by reference in its entirety.

In other cases, portions of the separated portion may bond with portions of the insert member so as to fix the insert member in place within the separated portion. For example, an inside layer of a separated portion, may be impregnated with adhesive or other bonding material, such as hot melt adhesive, or may be made using a fusible yarn, so that the inside layer of the separated portion may be bonded, heat welded, or joined to an outside layer of the insert member.

Similarly, portions of the insert member may be impregnated with adhesive or other bonding material, or may be made using a fusible yarn or non-woven hot-melt material to join with the inside layer of the separated portion. In still other cases, portions of both the separated portion and the insert member may include provisions to assist with fixing the insert member in place.

Figure 15:
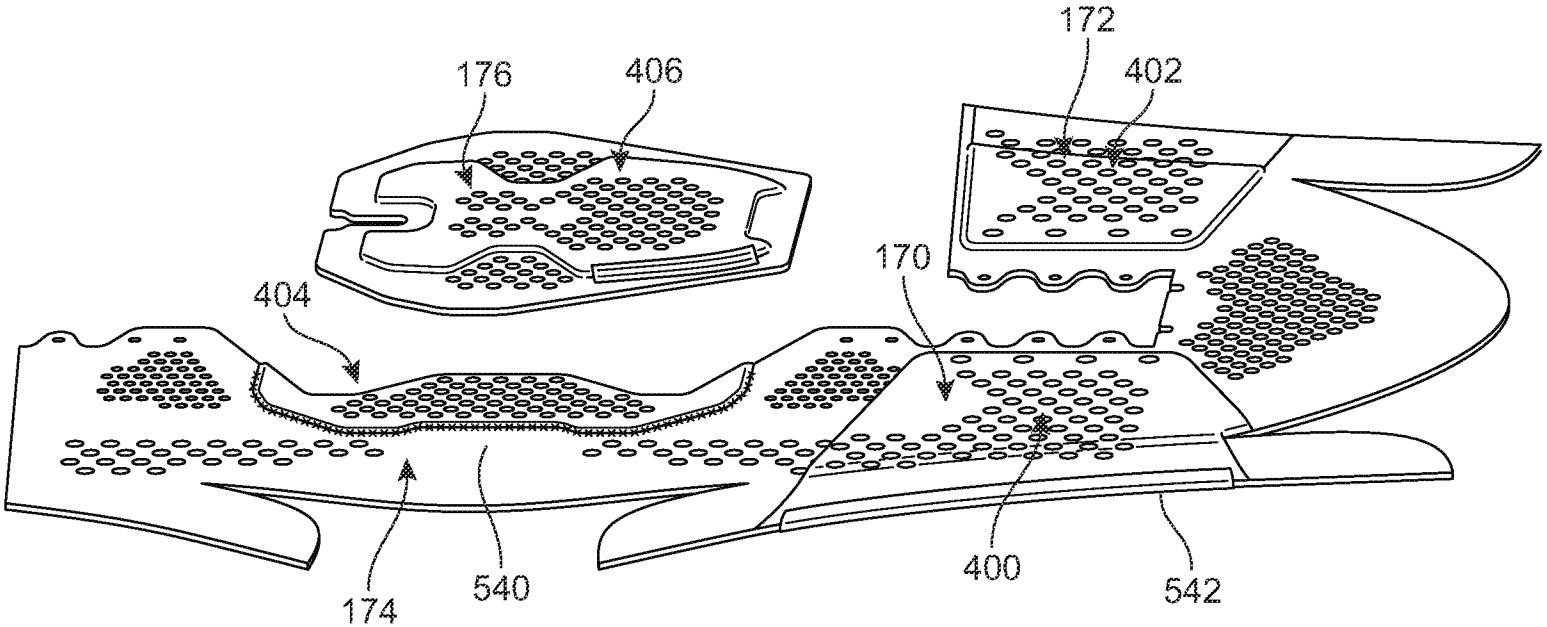
FIG. 15 is a schematic isometric view of an embodiment of a knitted component, in which various methods for closing a separated portion are illustrated.

Referring next to FIG. 15, each separated portion can be closed using any methods known in the art for closing and/or finishing textile materials. For purposes of illustration, FIG. 15 shows several different methods for closing the separated portions so that the insert members are retained inside. For example, third separated portion 404 may be closed using stitching 540. Likewise, first separated portion 400 may be closed using bonding tape 542. In a similar manner, second separated portion 402 and fourth separated portion 406 could be closed using any similar methods. In some embodiments, portions of knitted component 140 may be made using materials that may be welded or bonded to close the separated portions without needing additional components. For example, knitted component 140 may include fusible materials, including fusible yarns, fibers, woven or non-woven fabrics or materials, or may include materials that are impregnated with adhesives or bonding materials to facilitate closing separated portions without additional components.

Other possible methods for closing separated portions include, but are not limited to, staples, various kinds of adhesives, fusing methods (such as high frequency welding) as well as other methods known in the art for joining, bonding or otherwise finishing textile materials. Moreover, any of these methods could be used to finish one or more edges of knitted component 140 prior to forming a finished upper.

When closed up, each separated portion with a corresponding insert comprises a reinforced portion for the upper being formed. Thus, first separating portion 400 and first insert member 180 comprise first reinforced portion 170. Likewise, second separating portion 402 and second insert member 182 comprise second reinforced portion 172. Third separating portion 404 and third insert member 184 may comprise third reinforced portion 174. Fourth separating portion 406 and fourth insert member 186 comprise fourth reinforced portion 176. By varying the material and/or structure used for an insert member, various properties of first reinforced portion 170, second reinforced portion 172, third reinforced portion 174 and fourth reinforced portion 176 may be tuned to achieve desired degrees of support, rigidity, padding, cushioning as well as any other material and/or structural properties for the reinforced portions.

Figure 16:
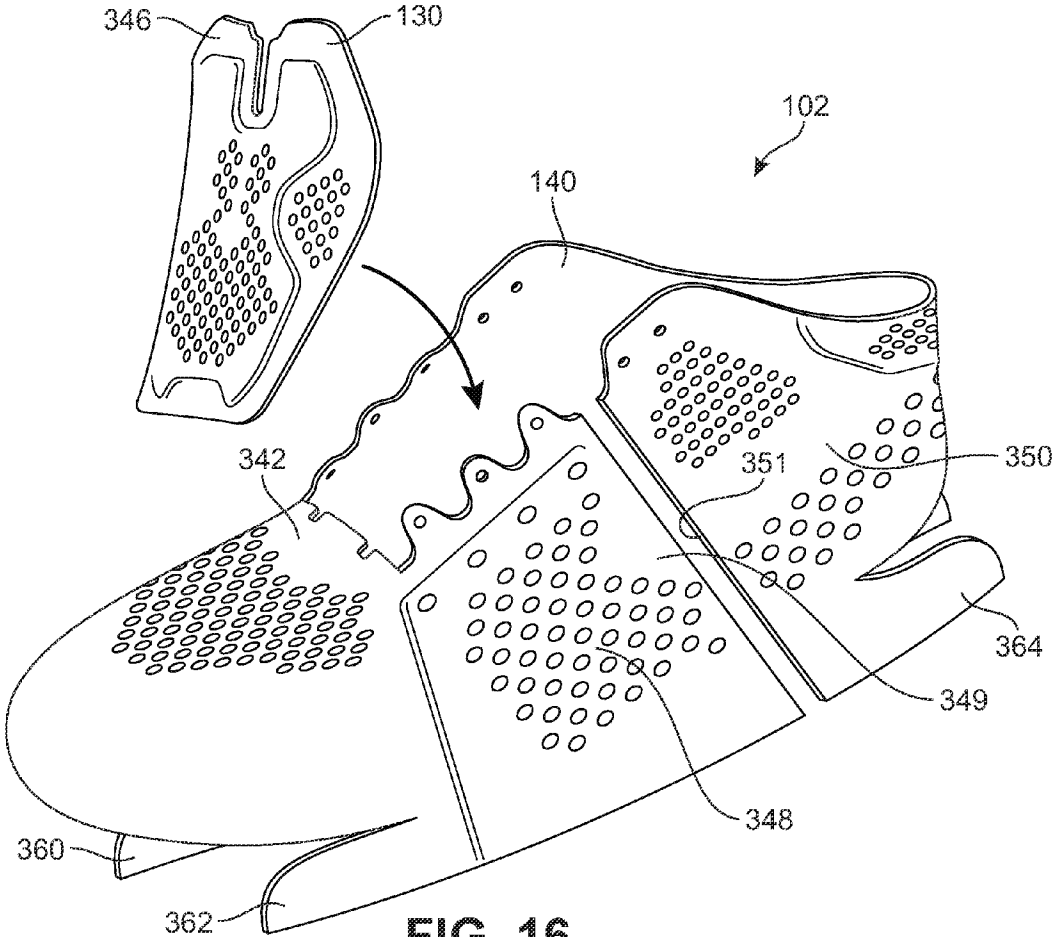
FIG. 16 is a schematic isometric view of an embodiment of a knitted component being formed into an upper.

Referring next to FIG. 16, portions of knitted component 140 may be secured together to form a finished upper 102. For example, edge 349 of first medial section 348 may be secured to edge 351 of second medial section 350 to form seam 150 on medial side 18 of upper 102 (see FIG. 2). Additionally, corresponding edges of first bottom section 360, second bottom section 362 and third bottom section 364 may be secured together to form seam 152 and seam 153 on bottom portion 106 of upper 102. Furthermore, tongue section 346 may be secured to forefoot section 342 using stitching, adhesives or any other bonding or joining methods.

The various edges may be secured together using stitching, an adhesive or heat bonding, for example. Knitted component 140, as depicted in FIG. 15, has a generally planar configuration. Upon the formation of seam 150, however, one portion of knitted component 140 overlaps the other portion of knitted component 140. The volume between the overlapping portions effectively forms a portion of the void within upper 102 for receiving the foot.

Following the formation of each of seam 150, seam 152 and seam 153, the manufacturing of upper 102 is essentially complete. In some embodiments, various finishing steps may be performed, such as reinforcing one or more portions and/or openings, as well as finishing one or more edges, for example.

Figure 17:
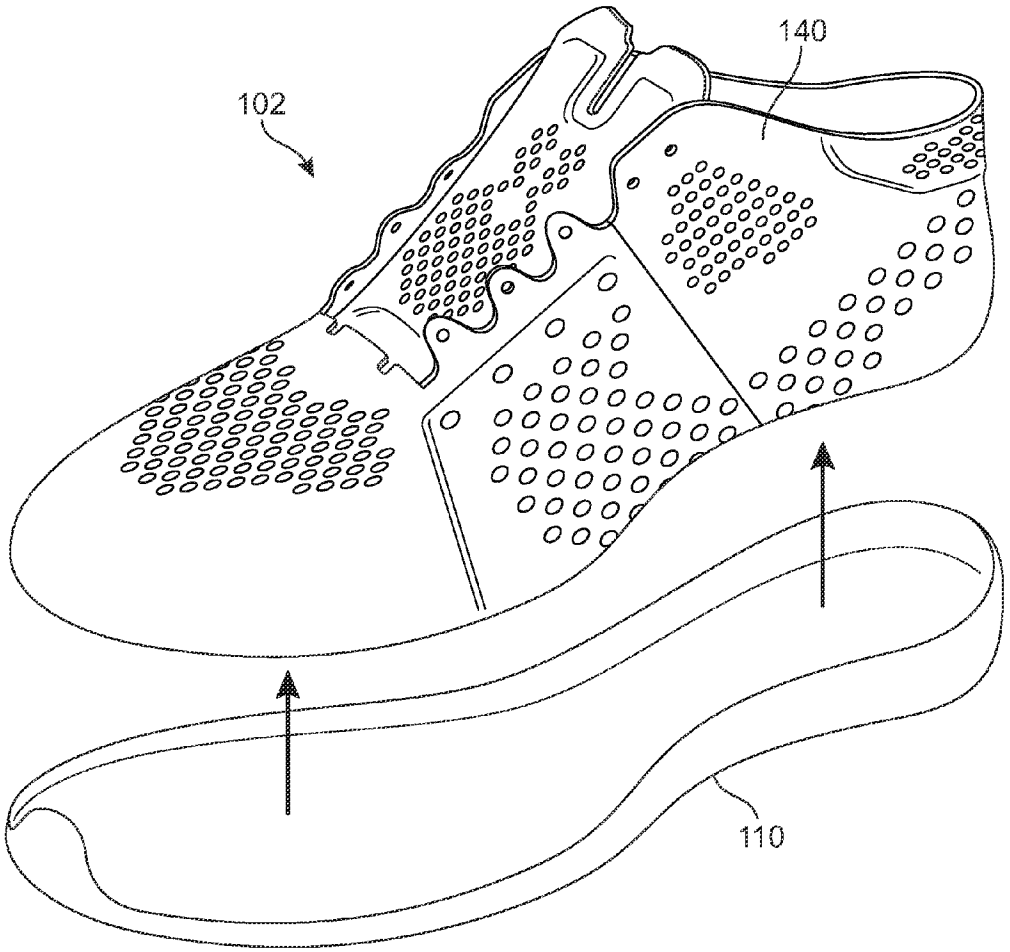
FIG. 17 is a schematic isometric view of an embodiment of a textile upper being associated with a sole structure.

As seen in FIG. 17, following the formation of upper 102, in some embodiments upper 102 (i.e., knitted component 140) is then secured to sole structure 110, with an adhesive, for example. In some embodiments, various reinforcing members may be added to the exterior or interior surface of upper 102 in order to limit the degree of stretch in upper 102 or provide enhanced wear-resistance. In addition, in some embodiments, a lacing system may be added to provide adjustability.

Figure 18:
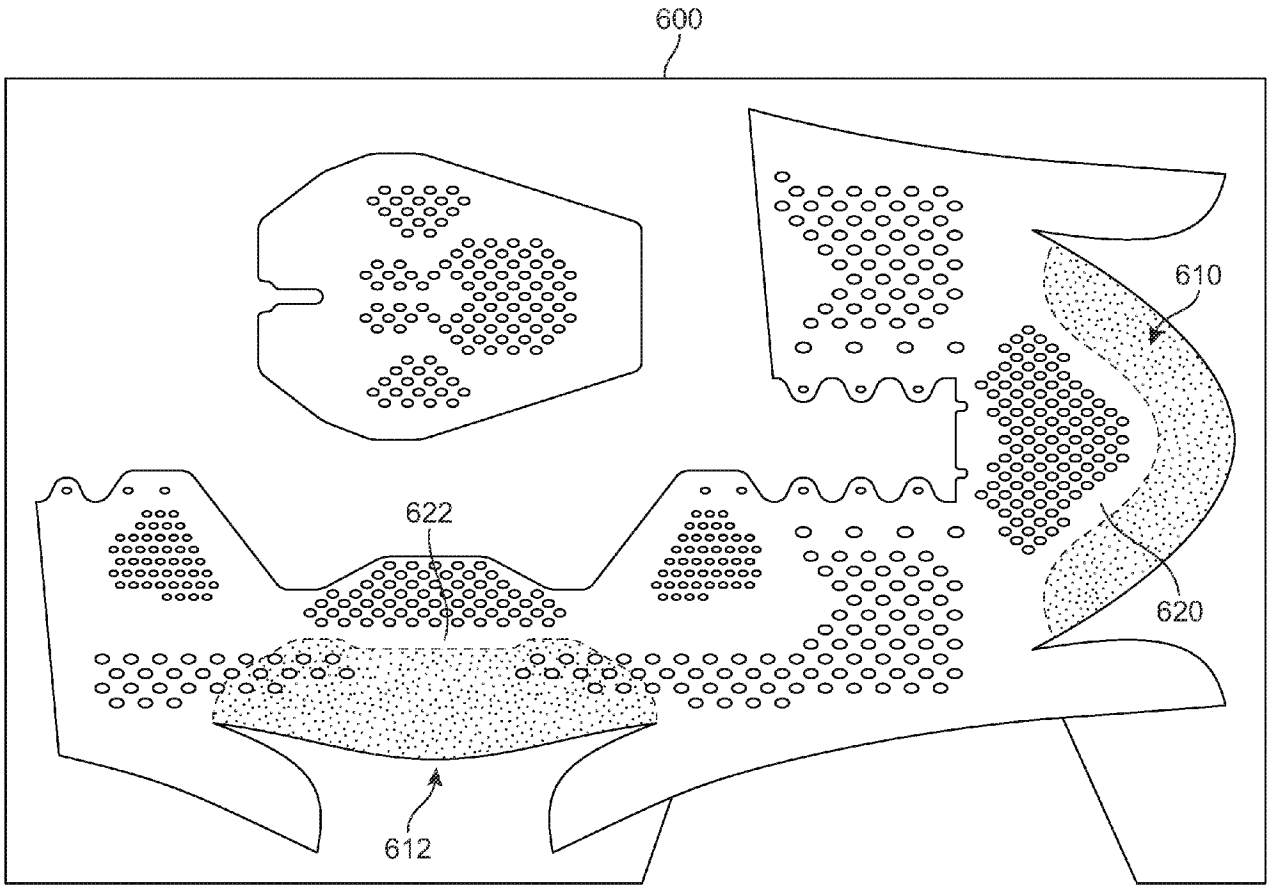
FIG. 18 is a plan view of another embodiment of a knitted textile element including various separated portions.

FIG. 18 illustrates an alternative embodiment of a knitted textile element 600. Knitted textile element 600 may be similar in some respects to knitted textile element 300. Knitted textile element 600 may incorporate sections that can be cut out and joined to create an upper for an article of footwear. In the current embodiment, knitted textile element 600 is provided with a first separated portion 610 and a second separated portion 612 corresponding to a toe section 620 and a lower heel section 622, respectively. These separated portions may be further filled with inserts or other reinforcing material to provide cushioning and/or durability to the toe portion and lower heel portion of an upper. For example, in some embodiments, this alternative arrangement allows a relatively rigid material to be inserted into second separated portion 612 to form a heel counter for an upper.

It will be understood that the structures and methods described here may be applied to a variety of different articles, including articles of apparel. In other words, these structures and methods may not be limited to articles of apparel. Exemplary articles into which the structures discussed here could be employed include, but are not limited to: shirts, pants, gloves, socks, hats, jackets, undergarments as well as possibly other kinds of articles of apparel.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper incorporating a knitted component;

the knitted component having a first portion that comprises a single layer of material and the knitted component having a second portion that comprises a plurality of areas of the knitted component having two layers of material that are separated to form a plurality of pockets in the knitted component; and wherein an outer side of the first portion is formed of unitary knit construction with a first layer of the second portion and wherein an inner side of the first portion is formed of unitary knit construction with a second layer of the second portion.

2. The article of footwear according to claim 1, wherein the knitted component is a warp-knitted textile material.

3. The article of footwear according to claim 1, wherein the knitted component includes a knitted indicating portion corresponding to a portion for cutting open the second portion.

4. The article of footwear according to claim 1, wherein an insert material is disposed within at least one of the plurality of pockets of the second portion.

5. The article of footwear according to claim 4, wherein the insert material is fixed in place within the at least one of the plurality of pockets.

6. The article of footwear according to claim 5, wherein the insert material is attached to a portion of the at least one of the plurality of pockets.

7. The article of footwear according to claim 5, wherein the insert material is disposed between opposite sides of the at least one of the plurality of pockets that are attached to each other.

8. The article of footwear according to claim 1, wherein the outer side comprises a first set of yarns and wherein the inner side comprises a second set of yarns that is substantially different from the first set of yarns.

9. The article of footwear according to claim 8, wherein the first set of yarns and the second set of yarns comprise substantially different materials.

10. The article of footwear according to claim 8, wherein the first set of yarns are knitted into a first knit configuration and wherein the second set of yarns are knitted into a second knit configuration that is substantially different from the first knit configuration.

11. The article of footwear according to claim 8, wherein the first layer of the second portion comprises the first set of yarns and wherein the second layer of the second portion comprises the second set of yarns.

12. The article of footwear according to claim 1, wherein the plurality of pockets are located at least on two different portions of the article of footwear.

13. The article of footwear according to claim 1, wherein the plurality of pockets includes pockets disposed along two or more of: a medial side, a lateral side, a tongue, and a heel portion of the article of footwear.

14. A knitted component for incorporating into an upper of an article of footwear, the knitted component comprising:

a first portion that comprises a single layer of material; and a second portion that comprises a plurality of areas of the knitted component having two layers of material that are separated to form a plurality of pockets in the knitted component;

wherein an outer side of the first portion is formed of unitary knit construction with a first layer of the second portion and wherein an inner side of the first portion is formed of unitary knit construction with a second layer of the second portion.

15. The knitted component according to claim 14, wherein the knitted component is removed from a knitted textile element.

16. The knitted component according to claim 15, wherein the knitted component includes a first section removed from the knitted textile element forming the upper of the article of footwear and a second section removed from the knitted textile element forming a tongue of the article of footwear.

17. The knitted component according to claim 14, wherein the knitted component is a warp-knitted textile material.

18. The knitted component according to claim 14, wherein the outer side comprises a first set of yarns and wherein the inner side comprises a second set of yarns that is substantially different from the first set of yarns.

19. The knitted component according to claim 18, wherein the first set of yarns and the second set of yarns comprise substantially different materials.

20. The knitted component according to claim 18, wherein the first set of yarns are knitted into a first knit configuration and wherein the second set of yarns are knitted into a second knit configuration that is substantially different from the first knit configuration.

21. The knitted component according to claim 18, wherein the first layer of the second portion comprises the first set of yarns and wherein the second layer of the second portion comprises the second set of yarns.

22. The knitted component according to claim 14, wherein the first portion comprising the single layer of material is disposed between at least two of the plurality of pockets.

23. The knitted component according to claim 14, wherein the plurality of pockets are located at least on two different portions of the knitted component.

* * * * *